US005641050A

United States Patent [19]

Smith et al.

[11] Patent Number: 5,641,050

[45] Date of Patent: Jun. 24, 1997

[54] DISPENSING MACHINE WITH DATA CARD SCANNER APPARATUS AND ENHANCED FEATURES

[75] Inventors: Gerald W. Smith, Solano County; Dich C. Tran, Santa Clara County, both of Calif.

[73] Assignee: Verifone, Inc., Redwood City, Calif.

[21] Appl. No.: 375,124

[22] Filed: Jan. 17, 1995

Related U.S. Application Data

[63] Continuation of Ser. No. 37,736, Mar. 26, 1993, abandoned, which is a continuation of Ser. No. 775,266, Oct. 11, 1991, abandoned.

[51] Int. Cl.[6] ..... G07F 7/08

[52] U.S. Cl. ..... 194/210; 194/217; 235/381

[58] Field of Search ..... 194/206, 207, 194/208, 209, 210, 217, 218; 235/381, 383

[56] References Cited

U.S. PATENT DOCUMENTS

| | | | |
|---|---|---|---|
| 3,362,515 | 1/1968 | Yamamoto et al. | 194/210 |
| 3,560,715 | 2/1971 | Akamatsu . | |
| 3,602,695 | 8/1971 | Boss . | |

(List continued on next page.)

FOREIGN PATENT DOCUMENTS

| | | |
|---|---|---|
| 1173540 | 8/1984 | Canada . |
| 3142310 | 6/1982 | Germany . |

OTHER PUBLICATIONS

Verifone, Inc. —Marketing Brochure, ValuCard Systems, Mar. 1991.

Verifone, Inc. —Marketing Brochure, Verifone Transaction SuperSystems —Garnet, Apr., 1991.

Verifone, Inc. —Annual Report, Annual Report, 1990.

VeriFone, Inc. —TRANZ 330 Reference Manual, TRANZ 330 Reference Manual, Jul., 1988.

Securities and Exchange Commission —Form 10–K, SEC Form 10–K —Annual report pursuant to Section 13 or 15(d) of the Securities and Exchange Act of 1934 for the fiscal year ended Dec. 28, 1990.

VeriFone, Inc. —Transaction Automation Marketing Brochure, Transaction Automation, Jan. 1991.

MARS Electronics Marketing Brochure, Presenting MARS Multicard.

MARS Electronics Marketing Brochure, Multicard, 1987.

(List continued on next page.)

*Primary Examiner*—F. J. Bartuska

*Attorney, Agent, or Firm*—Flehr Hohbach Test Albritton & Herbert LLP

[57] ABSTRACT

A dispensing machine payment acceptance apparatus for dispensing products or services from a dispensing machine upon user request and payment is disclosed. The apparatus comprises a data card scanner apparatus for acquiring payment and other information. It also comprises an electrical signals interface between the scanner and the dispensing machine to indicate proper payment has been made. Cash payment, such as coins and paper bills, may also be accepted and apparatus is disclosed in the dispensing machine payment acceptance apparatus for generating electrical signals indicative of an amount of cash accepted. The invention discloses a card swallowing feature which enable the scanner to retain the card when the data card is defective or has other predetermined characteristics. In some embodiments the scanner has a geometrical form factor substantially similar to a standard bill validator apparatus. The scanner has selectable firmware and will be connector plug compatible with most vending machine signal requirements when used with the proper scanner interface. No structural or electrical modifications to the existing vending machine hardware are required beyond plugging and unplugging connectors.

5 Claims, 21 Drawing Sheets

U.S. PATENT DOCUMENTS

| | | | |
|---|---|---|---|
| 3,774,743 | 11/1973 | Hendrickson . | |
| 3,786,421 | 1/1974 | Wostl et al. | 235/381 |
| 3,826,344 | 7/1974 | Wahlberg . | |
| 3,828,903 | 8/1974 | Levasseur . | |
| 3,836,753 | 9/1974 | Pass . | |
| 3,872,438 | 3/1975 | Cuttill et al. . | |
| 3,935,933 | 2/1976 | Tanaka et al. . | |
| 4,020,325 | 4/1977 | Pfost et al. . | |
| 4,048,475 | 9/1977 | Yoshida . | |
| 4,151,564 | 4/1979 | Schreiber et al. . | |
| 4,254,857 | 3/1981 | Levasseur et al. . | |
| 4,271,351 | 6/1981 | Bloodworth . | |
| 4,300,042 | 11/1981 | Oldenkamp et al. . | |
| 4,361,754 | 11/1982 | Hoskinson et al. . | |
| 4,449,186 | 5/1984 | Kelly et al. . | |
| 4,458,187 | 7/1984 | Heiman . | |
| 4,513,199 | 4/1985 | Sidline . | |
| 4,518,852 | 5/1985 | Stockburger et al. . | |
| 4,527,052 | 7/1985 | Kilborn . | |
| 4,669,596 | 6/1987 | Capers et al. | 194/210 |
| 4,752,676 | 6/1988 | Leonard et al. . | |
| 4,767,917 | 8/1988 | Ushikubo | 235/381 |
| 4,778,983 | 10/1988 | Ushikubo | 235/381 |
| 4,812,629 | 3/1989 | O'Neil et al. | 235/383 |
| 4,817,010 | 3/1989 | Dobbins | 364/479 |
| 4,879,744 | 11/1989 | Tasaki et al. | 379/144 |
| 4,884,212 | 11/1989 | Stutsman | 364/479 |
| 4,954,697 | 9/1990 | Kokubun et al. | 235/381 |

OTHER PUBLICATIONS

MARS Electronics Marketing Brochure, Cashless Vending —Multicard MS 5504/10, 4 & 10 Price Controllers, Jun., 1986.

MARS Electronics Marketing Brochure, Cashless Payment Systems, 1988.

MARS Electronics Marketing Brochure, Multicard, Feb., 1985.

MARS Electronics Marketing Brochure, Multicard —Product Guide, Mar., 1987.

DISPENSING MACHINE WITH DATA CARD SCANNER APPARATUS AND ENHANCED FEATURES

This is a continuation of Ser. No. 08/037,736 filed Mar. 26, 1993, now abandoned; which is a continuation of Ser. No. 07/775,266 filed Oct. 11, 1991, now abandoned.

CROSS-REFERENCE TO RELATED APPLICATIONS

Following applications assigned to the same assignee are incorporated herein by reference: U.S. patent application Ser. No. 775,738, now U.S. Pat. No. 5,434,404, Entitled "Linear Scanner Apparatus for Communicating with a Data Card"; U.S. Pat. No. 5,440,108 issued Aug. 8, 1995, Entitled "System and Method for Dispensing and Revaluing Cash Cards"; and U.S. patent application Ser. No. 777,764, now U.S. Pat. No. 5,291,003, Entitled "Modular Cash Card System Design", all filed Oct. 11, 1991.

BACKGROUND OF THE INVENTION

1. Field of the Invention

This invention relates to the field of unattended machines for dispensing or vending products and services and more specifically relates to the field of dispensing machines that permit access using a plurality of payment means including data cards.

2. Description of the Related Art

Machines for the unattended vending or dispensing of products are commonplace. In the past, the types of items dispensed were generally limited to relatively inexpensive items such as for example candy, cigarettes, and soft drinks. The type of items dispensed and the relatively larger value of a dollar in the past, compared to its value today, meant that vended purchases could generally be made with a few coins.

The expansion of the vending machine sales methodology to more sophisticated and higher priced items, coupled with general economic inflation has resulted in many items whose purchase price exceeds the average consumer's pocket or purse change. Consumers with sufficient cash, but in paper bills rather than coins, were turned away from such machines in frustration. On occasion, change could be obtained from another person or merchant, but asking for change may be somewhat demeaning, and providing change was often a nuisance to the provider, particularly if provided by a competing merchant in the vicinity. The vending machine owner or operator also suffered due to lost sales.

An limited solution was provided by the introduction of a bill changer in proximity to the coin operated vending machine. A bill changer is generally a stand-alone machine which provisionally accepts paper currency, generally of a fixed denomination, performs some validation to assure its authenticity, and then presents an equivalent amount of change for the customer which could subsequently be used in the coin operated machines. This permitted continued use of the coin operated machines at only moderate consumer inconvenience. However, provision of bill validators may have been economically practical only if several vending machines were collocated and shared a single bill changer. The cost of the bill changer and the requirement to fill the bill validator with coins, essentially a non-interest bearing remote bank account, making the provision of stand-alone bill changers for each vending machine somewhat prohibitive. Security is also a concern, since the unattended cash is attractive to potential thieves.

As new vending machines have been produced, the ones capable of vending higher priced items may incorporate a bill validator as a standard module, or be designed to be retrofitted with one. The provision of a integral bill validator in addition to the traditional coin operation fulfills some of the consumer's needs but leaves other problems unsolved.

The bill validators initially installed either integrally or as stand-alone units were typically configured to accept U.S. one-dollar notes. In some markets, higher valuation bills, such as U.S. five-dollar notes may be accepted but these are unusual rather than commonplace features.

As a result, consumers having sufficient cash may still be frustrated by not having cash in the proper form for the machine to accept, in this case coins or one-dollar bills. The consumer may actually be in a more difficult position when attempting to get change, from for example a 20-dollar bill, because of the greater amount of money involved. The provision of coin acceptors or fixed-denomination bill changers has not kept up with the higher valuation of products and the effects of inflation. The vending machine owner still looses profit because of lost sales.

The rationale for limiting the denomination of paper currency accepted is somewhat persuasive from the standpoint of the vending machine owner or operator. Security and loss of potential investment interest are the primary additional concerns. The acceptance of larger denomination bills necessarily requires larger amounts of change internal to the machine. This constitutes a greater initial monetary investment to fund operation, results in loss of interest income which could be gained on the same funds if deposited into an interest bearing account, and presents a greater threat from theft because of the larger amounts of cash involved. The potential loss by the use of counterfeit currency is also greater since larger amounts of genuine coins could be extracted more quickly with larger counterfeit notes.

Operation of machines that accept multiple denomination paper currency, such as one-dollar, five-dollar, ten-dollar, and twenty-dollar notes, present additional problems. Such a bill validator may require substantial additional technological sophistication to discriminate among the accepted paper currency denominations and to detect counterfeit currency. It is economically difficult to justify placing this high level of complexity in the large number of machines needed to satisfy consumer demand.

These problems affect both the potential purchaser of products from the dispensing machines and the owner or operator of the vending machine. There are other longer term affects on the vending machine marketing concept which results from continued use of machines which accept only coins or currency.

Consumers are becoming more comfortable in performing relatively large financial transactions through the use of a card of some type and possibly a personal identification number (PIN). Such access is becoming common for unattended access to bank teller machines, public transportation systems, and the unassisted purchase of airline travel tickets for example. There are many other examples.

Given this trend, consumers are more comfortable making unattended purchases involving larger monetary amounts with non-currency devices. The faster paced lifestyle also encourages purchases, or rentals, from unattended machines which offer the potential of 24-hour access. The requirement for cash stalls this potential growth area and is an inconvenience to customers.

It is also advantageous to the vending machine owner or operator to have a machine capable of cash free operation.

Cash free operation, especially if the cash free operation is recognized by the potential thief, eliminates the problems associated with theft and theft based vandalism.

It also eliminates the need for loss of interest on a possibly substantial cash fund within the machine.

For a part of the consuming public bank credit cards could provide the flexibility needed to access the more sophisticated dispensing machines that are being introduced today. However, their are serious problems with reliance on these existing credit or debit methods.

One immediate problem from the standpoint of a vending machine owner is the potentially very high per purchase transaction charge levied by the banks on their bank credit cards for such transactions. These transaction charges may be acceptable for the larger purchases but may be unacceptable from a merchants or consumers point of view for individual item transactions of a few dollars or less. This type of access would not be suitable for all types of purchases.

A second problem associated with the reliance on bank credit cards is the fact that not all segments of the public qualify for credit cards, minors in particular constitute a significant segment of the vending market who would not have credit cards. Other market segments do not generally, or perhaps at the time the purchase is desired, have an appropriate credit balance to allow the transaction to go through.

There is also necessity of some communication link with the bank or other administrative organization for approval. Even if such a communication link is provided, the processing delay may be unacceptable during peak purchasing periods and would discourage use.

Other persons may be hesitant to use their credit card for minor transactions. A further potential problem relates to personal privacy in an age of data bases which track an individuals every move and purchase. There are individuals who prefer to operate on a financial basis that approaches the anonymity associated with cash. Bank credit cards do not permit such anonymity.

Other individuals may hesitate to deposit their bank credit card in an unattended location, where mechanical or electrical failure could preclude card recovery and force a customer to abandon their credit card. This same concern is not present at such machines as bank teller machines due to the perception of greater reliability of these machines, or alternately that in the event of some failure, the card will be kept by the financial institution and will not fall into unauthorized hands, thereby subjecting the card owner to relatively unlimited financial liability.

Beyond the actual problems associated with the aforementioned cash or credit card transactions, there are other limitations associated with these access techniques. The promotional use of discount coupons has long been employed to facilitate sales of new products, for example. There is no known existing equivalent method of promoting a first purchase of a new item from a vending machine by a particular market segment. The price of a vended items may be attractively reduced, but this may result in loss of profits from persons making multiple purchases of that item at the reduced, perhaps unprofitable price. Alternatively, the general public rather than a specific market segment may be induced to buy, again diminishing profits.

It is also highly desirable that if some type of debit card implementation is used, then the cards should be transportable and capable of use in a variety of similar machines. This gives the consumer confidence that his investment will not be wasted if he does not return to the data card issuing location.

Another problem associated with expanding the nature and scope of vending machine access instruments is the large inventory of existing vending machines which owners would prefer to operate for the remainder of their useful life. Therefore there is a desirability of retrofitting any improvement to these devices within the existing vending machine structure.

Supplementary devices which attach to the machine externally, either by direct attachment or by a separate stand-alone unit are problematic in that they either consume additional floor space which may not be available, create a safety problem by extending from the front of a vending machine into the room, or result in inefficient space utilization and potential loss of sales if they are mounted to the side of an existing vending machine. In the later case, vending machines in a multi-vending machine installation (such as a solid wall of adjacent machines) will have to be spaced at greater distance intervals, and where there is insufficient free space to extend the line of machines, some vending machines may have to be eliminated with consequential loss of product sales, which may not be made up by the sales of available items.

There have been attempts to satisfy the need and solve the aforementioned problems, but these prior attempts have not been successful.

Capers et al. (U.S. Pat. No. 4,669,596) describe an accessory to a cash operated vending machine which purports to permit operation by either money or coded card. However, it is externally mounted and does not provide the advanced features desirable in today's sophisticated consumer market. For example, the Capers et al. apparatus does not provide a data card retention feature, nor capabilities for promotional marketing. The Capers et al. apparatus also requires the conventional retention of a means for handling money and producing an electrical output signal in response to received money which precludes a simplified all debit card type of operation. This precludes a completely cash free operation, or requires the retention of unused internal cash handing equipment. The Capers et al. apparatus also requires structural modification to the vending machine for mounting the accessory.

An apparatus by Stutsman (U.S. Pat. No. 4,884,212) was also an attempt to satisfy the need and eliminate some of the aforementioned problems. However, it too failed to completely satisfy the need. The Stutsman apparatus was largely a self contained unit which stored most of its information in internal memory and only a minimum amount of data on the data card. Also, the Stutsman apparatus relies on a either an internal or a remote database to retain customer data. The information is not contained on the card, other than an identification code, and is not updated as transactions are made. The cards are prevalued and a card with the appropriate value is dispensed when payment is made; information is not written to the card at the vending location by the machine dispensing the card. Therefore it lacks the desired transportability. The Stutsman apparatus is an entire system and is not suitable for installation in existing machines lacking data card access means. The Stutsman apparatus also does not provide the advanced features desirable in today's sophisticated consumer market. For example, as with the Capers et al. apparatus, it does not provide a data card retention feature, nor capabilities for promotional marketing.

Thus, there has been a need for a method and apparatus for accessing unattended machines which dispense a range of products or services and which overcomes these problems and limitations. The present invention meets this need.

In response to this need it is an object of the present invention to provide a vending machine access method which can reduce or completely eliminate the need for cash money transactions.

Another object of the present invention is to provide a vending machine access method which can be added to existing vending machines without mechanical modifications and without changing or replacing the existing electrical components or wiring.

Another object of the present invention is to provide a vending machine which provides for non-cash access coupled with anonymity of personal actions.

Another object of the present invention is to provide a vending machine access method which is readily transportable from machine to machine.

Another object of the present invention is to provide a non-cash vending machine that does not require connection or access to an external database.

Another object of the present invention is to provide a vending machine that has a card retention capability for defective cards.

Another object of the present invention is to provide a vending machine that has enhanced security features.

Another object of the present invention is to provide a vending machine that provides for promotional marketing of selected products to selected market segments.

SUMMARY OF THE INVENTION

A dispensing machine payment acceptance apparatus for dispensing products or services from a dispensing machine upon user request and payment. The apparatus comprises a means for scanning a data card and acquiring payment information in the form of electrical signals. It also comprises means for interfacing the electrical signals with the dispensing machine to indicate proper payment has been made. Means for accepting cash payment and generating electrical signals indicative of an amount of cash accepted may also be provided in the dispensing machine payment acceptance apparatus, including coin acceptors and bill acceptors. Means for retaining or swallowing the data card when the data card is defective or has other predetermined characteristics may also be provided. In some embodiments the means for scanning a data card has a geometrical form factor substantially similar to a standard bill validator apparatus.

BRIEF DESCRIPTION OF THE DRAWINGS

The purpose and advantages of the present invention will be apparent to those skilled in the art from the following detailed description in conjunction with the drawings.

Figure 1:
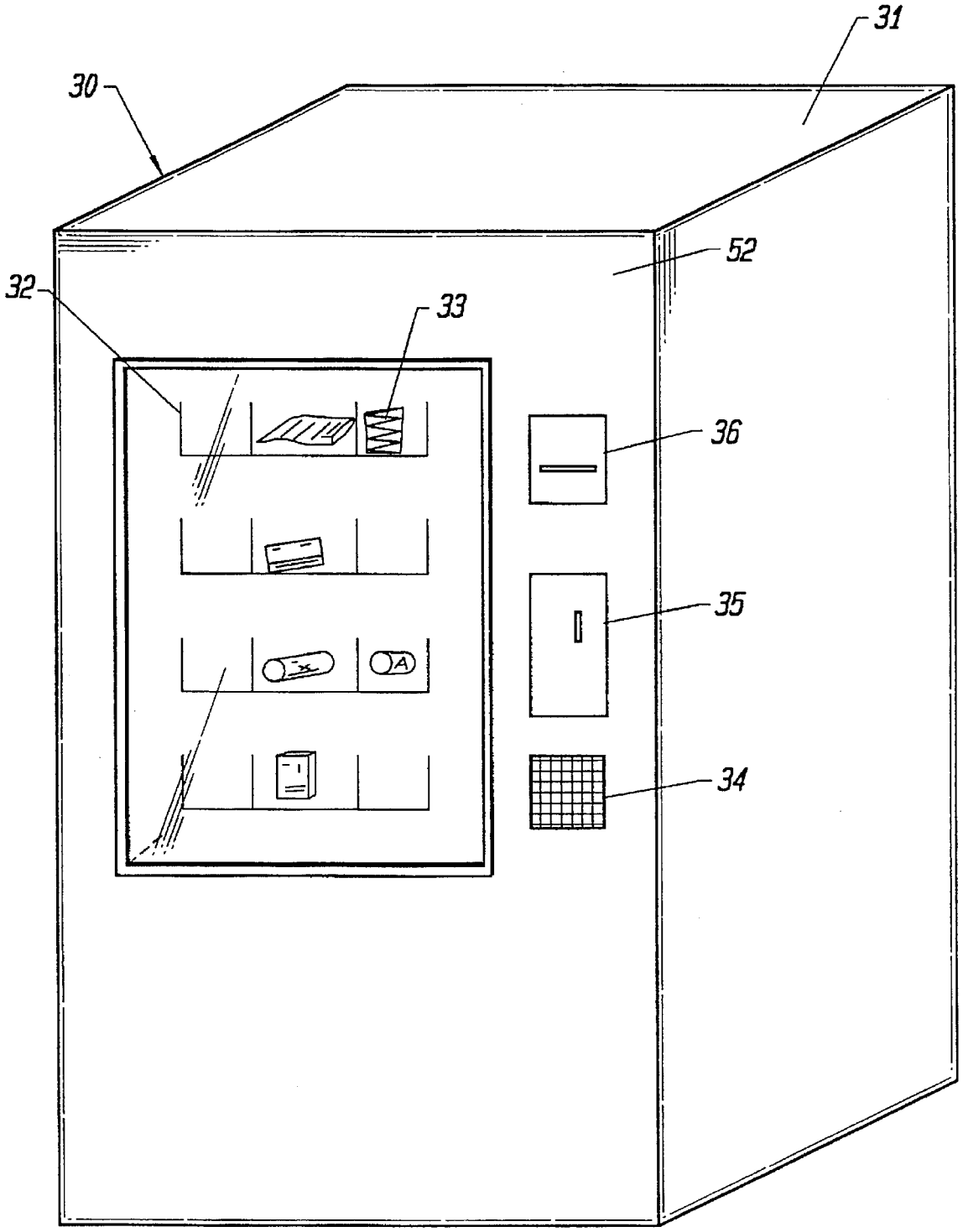
FIG. 1 is an illustrative drawing which shows an embodiment of a dispensing machine.

The purpose, structure and advantages of the current invention will be apparent to those skilled in the art from the following detailed description of a particular embodiment of the invention.

DESCRIPTION OF THE PREFERRED EMBODIMENT

The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded the widest scope consistent with the principles and features disclosed herein.

The present invention concerns a machine for dispensing products or services which has advanced features. The products or services may be accessed by a consumer who presents payment in a variety of forms, including a data card. The data card incorporates some means for storing information, and this information is advantageously used by the dispensing machine and allied equipment to provide advanced vending, convenience, and security features. Means for storing information may conventionally be accomplished using magnetic recording techniques. These advanced features may include, but are not limited to, the ability to set or restrict the maximum monetary value to the card, facilitation of promotional sales, the ability to retain possession of a data card under predetermined conditions and other enhanced security features. The present invention also advantageously provides a modular data card scanner for scanning a data card and associated electronic interface which is capable of very simple retrofit installation into existing dispensing machines which have a standard bill validator configuration or were designed to accept a standard bill validator at a later time. The invention may be installed without structural modifications to the dispensing machine if a standard bill validator has been installed previously. If a dispensing machine has been designed to accept the standard bill validator unit, then the data card scanner may be installed in its place either during initial manufacture or during a retrofit operation.

A vending machine has traditionally been associated with the unattended sale of inexpensive to modestly priced consumer products; snack foods and refreshments being common examples. The scope of machine rended products has expanded in recent years to encompass more expensive or more sophisticated consumer products than were traditionally available. However, the concept of a vending machine need not be limited to tangible products. Services may also be included within the context of machine vended items. One very traditional example of a pseudo-vending machine which provides services is the pay telephone. More recent examples of vended services are, for example, video games at video game parlors, and access to public transportation systems.

Many sales handled by a human cashier are amenable to vending machine concepts if the provided product or service can be sufficiently identified by machine without cashier, or equivalent human, interaction. Such payment means may substantially reduce payment queues in some instances. Other examples include restaurant meal counter payment and the unattended purchase of event tickets, for example.

In the context of the present invention, the terms vending machine or dispensing machine are intended to equivalently mean any unattended point of sale of product and/or service, and are not intended to be restricted to traditional vending machine concepts. In this regard, the term dispensing machine is used in preference to the term vending machine to encompass the anticipated broader scope of unattended sales that may result from technological advances, including this invention.

FIG. 1 is an illustrative drawing which shows an embodiment of a dispensing machine. This embodiment of a dispensing machine 30 comprises a machine housing 31, a product or service display area 32, including a plurality of product 33, a means for selecting product 34, a means for accepting coins 35, and a means for scanning a data card 36. The dispensing machine also comprises means for dispensing product, means for controlling dispensing, and means for interfacing which are generally internal to the dispensing machine housing 31 and are not shown in FIG. 1.

Means for selecting product 34 is conventionally some type of product selection apparatus 34 which the customer interacts with. Common examples are individual push buttons for each product, an alpha numeric keypad which associates an alphanumeric code with a product location, or some similar type of push button or touch-pad input device.

Means for accepting coins 35 is conventionally a coin acceptor device of which there are many types. An example of a common coin changer apparatus is the MC5 Coin Changer manufactured by Mars Electronics. The means for accepting coins such as a coin changer or the means for accepting bills (described below) provide a means for accepting cash payment. Both the coin acceptor and bill validator generate electrical signals indicative of the amount of cash accepted.

Means for dispensing product 37 is conventionally an electro-mechanical product dispensing apparatus which comprise devices such as motors, solenoids, or other mechanical actuators which respond to electronic signals. These product dispensing apparatus generally either move a product or allows a product to move from a storage location internal to the dispensing machine and present it to the customer. The electro-mechanical devices generally receive activating signals from the means for controlling dispensing 38. A common example of product dispensing apparatus are spiral lead screw type devices which rotate a certain number of turns under the control of an electric motor and move a product a linear distance to the end of a shelf associated with the lead screw, at which point the product is free to fall off of a storage shelf into a bin accessible to the customer. Another common example of such a product dispensing apparatus is a slidable or hinged access door wherein access is controlled by a solenoid type lock. Another example is a dispensing machine wherein product is stacked, such a beverage cans, and an electrical signal allows one item to fall into an access bin where it may be retrieved by a customer.

Means for controlling dispensing 38 is conventionally a dispensing controller which may be implemented by simple switches and electromagnetic relays. These switches and relays may receive activating signals or activating power after a product has been selected and sufficient payment has been received and supply the product dispensing apparatus 38 with activating power to actually dispense the product. The signals received by the dispensing controller 38 may be supplied directly by a coin changer 35 in some applications, by means for data card scanning 36, or from a means for interfacing 39 in a more sophisticated vending machine applications. The actual circuitry required by this dispensing controller is dependent on the application and may be as simple as electrical wires which conduct power to a motor or solenoid after an electronic switch or electromagnetic relay has opened or closed.

Means for scanning a data card 36 is conventionally a data card scanner apparatus and any required electronic interfaces, including firmware and software that may be required. The data card scanner apparatus 36 may generally be one of a number of types currently available on the commercial market, although not all will provide the same level of performance or enhanced features. Essential characteristics include transducers for detecting the data stored on the data card, at least one transducer for writing data to the data card, and an assembly for either scanning the card past the transducer or scanning the transducers past the card to accomplish the read and write functions. The transducers are conventionally of the type that transform electrical signals to magnetic fields or magnetic fields to electrical signals. Linear motion reader/writer mechanisms having fixed transducers are disclosed in patents by Pass, U.S. Pat. No. 3,386,753; Pfost et al., U.S. Pat. No. 4,020,325; and Redemacher, U.S. Pat. No. 4,879,607, which are hereby incorporated by reference. A rotary reader/writer mechanism is disclosed in U.S. patent application Ser. No. 07/679,944, filed May 9, 1991, also incorporated herein by reference. Each of the foregoing exemplary reader/writer mechanisms are appropriate for specific application where a variety of card thicknesses will not be encountered. However, to provide a more versatile system, the reader/writer mechanism should communicate with cards of a variety of thicknesses such that reconfiguration is not necessary to conform to a customer's needs. Therefore, a data card such as that which is disclosed in the application corresponding to U.S.

patent application Ser. No. 07/775,738, filed Oct. 11, 1991, assigned to the assignee hereof, which is incorporated by reference, is preferred. Other advantages of this scanner are that it uses advanced security measures to thwart fraud, it maintains the card within the system during the revolve process, and it is compact. This linear scanner also provides a card swallow feature which swallows the data card upon the determination of invalidity, damage, or excessive wear.

Means for interfacing 39 is conventionally an electrical interface which receives electrical signals from an apparatus such as a coin changer 35 or data card scanner 36, and processes the signals in an appropriate manner so as to present them to the vending machine dispensing circuitry, generally the dispensing controller 38, in a format that can be understood and used by the dispensing controller 38 to carry out the intended functions, such as dispensing a particular product. Common examples of interfaces are electrical wires, optical communications links, interfaces that provide electrical buffering and amplification, and interfaces that perform logical operations on the received signals. Specific examples of interfaces used for particular embodiments of the present invention are described subsequently.

Figure 2:
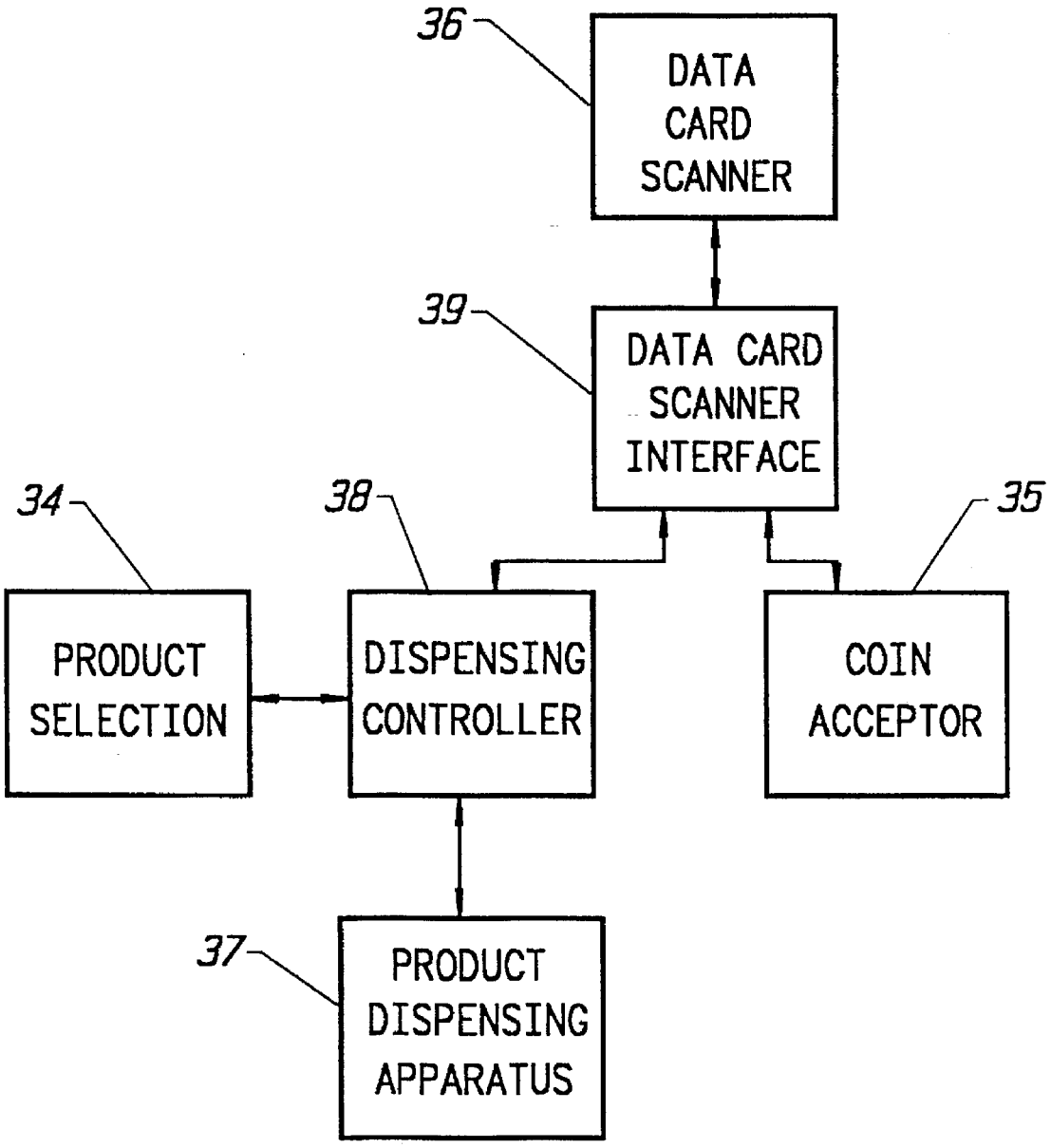
FIG. 2 is an illustrative drawing which shows a block diagram of an embodiment of a dispensing machine according to this invention as illustrated in FIG. 1.

FIG. 2 is an illustrative drawing which shows a block diagram of the major vending machine elements and their relationship in an embodiment of a dispensing machine according to this invention as illustrated in FIG. 1. It diagrammatically illustrates a product selection apparatus 34, a coin acceptor 35, a data card scanner 36, a product dispensing apparatus 37, dispensing controller 38, and a scanner interface 39 and the connectivity between them.

In the embodiment of the invention illustrated in FIG. 1 and FIG. 2, the scanner interface 39 is interposed between a coin acceptor 35 and a dispensing controller 38 of the conventional configuration thereby replacing the direct connection between these elements in the conventional configuration.

Inclusion of a coin acceptor 35, a bill validator 41, and a data card scanner 36 including scanner interface 39 provides a very flexible multi-payment accepting dispensing machine.

Figure 3:
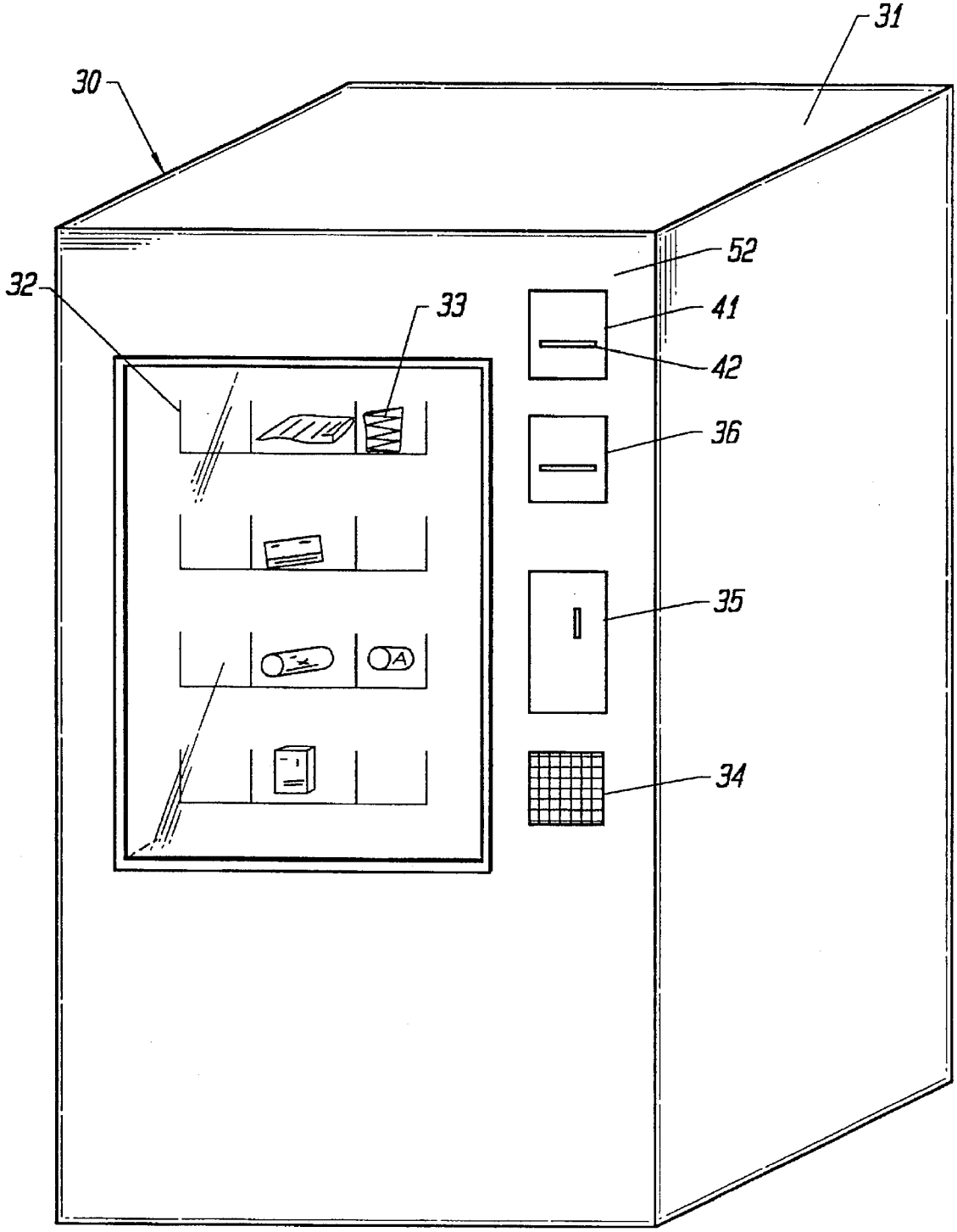
FIG. 3 is an illustrative that shows a dispensing machine similar to that shown in FIG. 2 with an additional element.

FIG. 3 is an illustrative drawing which shows a dispensing machine similar to that shown in FIG. 2 except for the addition of means for accepting a bill 41. Means for accepting a bill 41 is conventionally a bill validator, or bill acceptor apparatus. One dominant bill validator model is manufactured by Rowe International, Incorporated of Grand Rapids, Mich. 49507. The Rowe Model CBA-4 is generally characteristic of the standard size, electrical interface characteristics, and mechanical mounting method for dispensing machine bill validators 41.

The inclusion of a bill validator 41 somewhat changes the configuration of the elements but the operational principles remain substantially the same.

Figure 4:
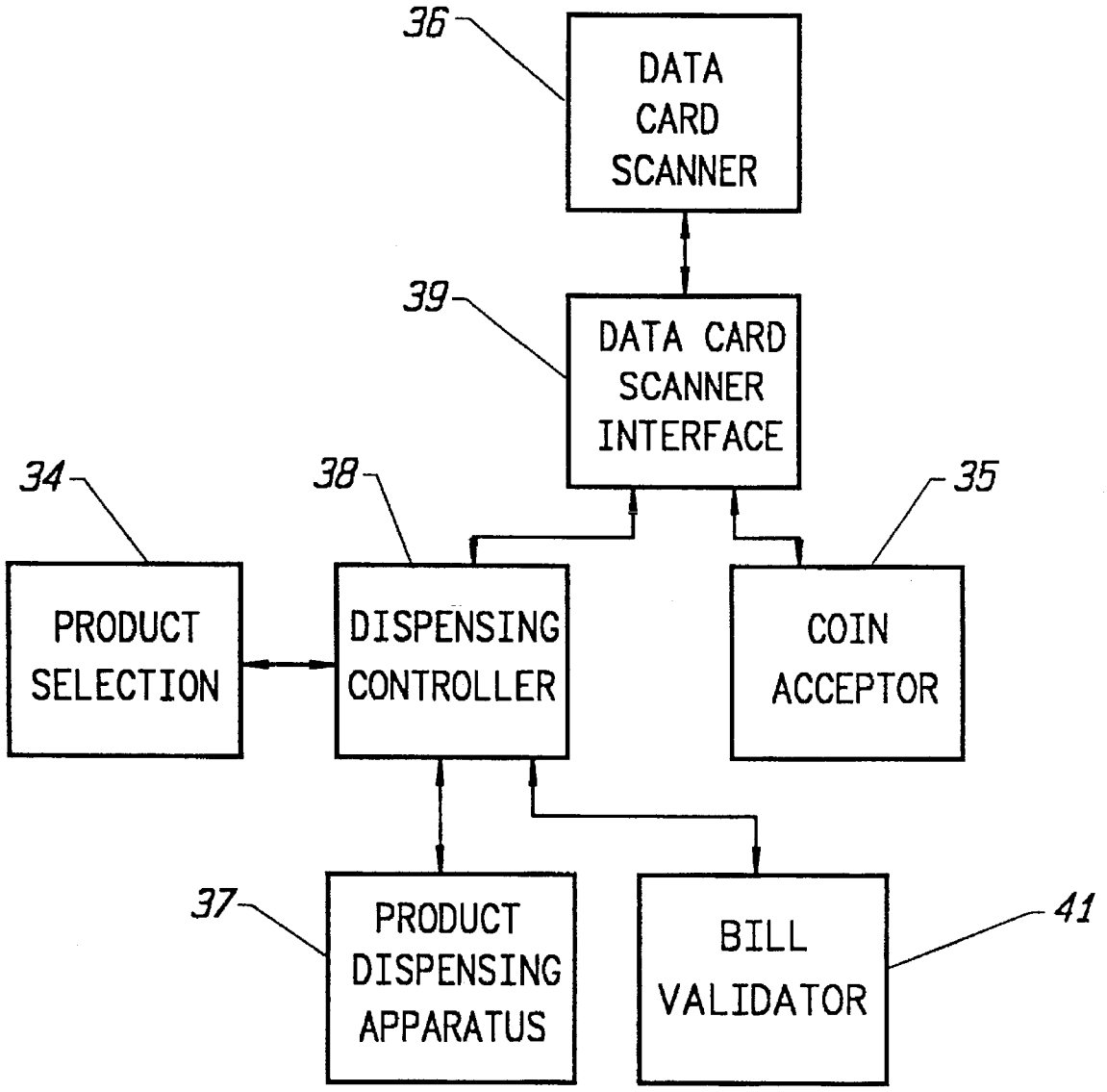
FIG. 4 is an illustration which shows a block diagram of the configuration of the elements of the embodiment illustrated in FIG. 3.

FIG. 4 is an illustration which shows a block diagram of the configuration of the elements of the embodiment illustrated in FIG. 3. The bill validator 41 is connected to dispensing controller 38. The other elements and their configuration may be substantially the same as in the embodiment of FIG. 2. It is also possible for the bill validator 41 to be connected to or through the coin acceptor 35 instead of directly to the dispensing controller 38.

Figure 5:
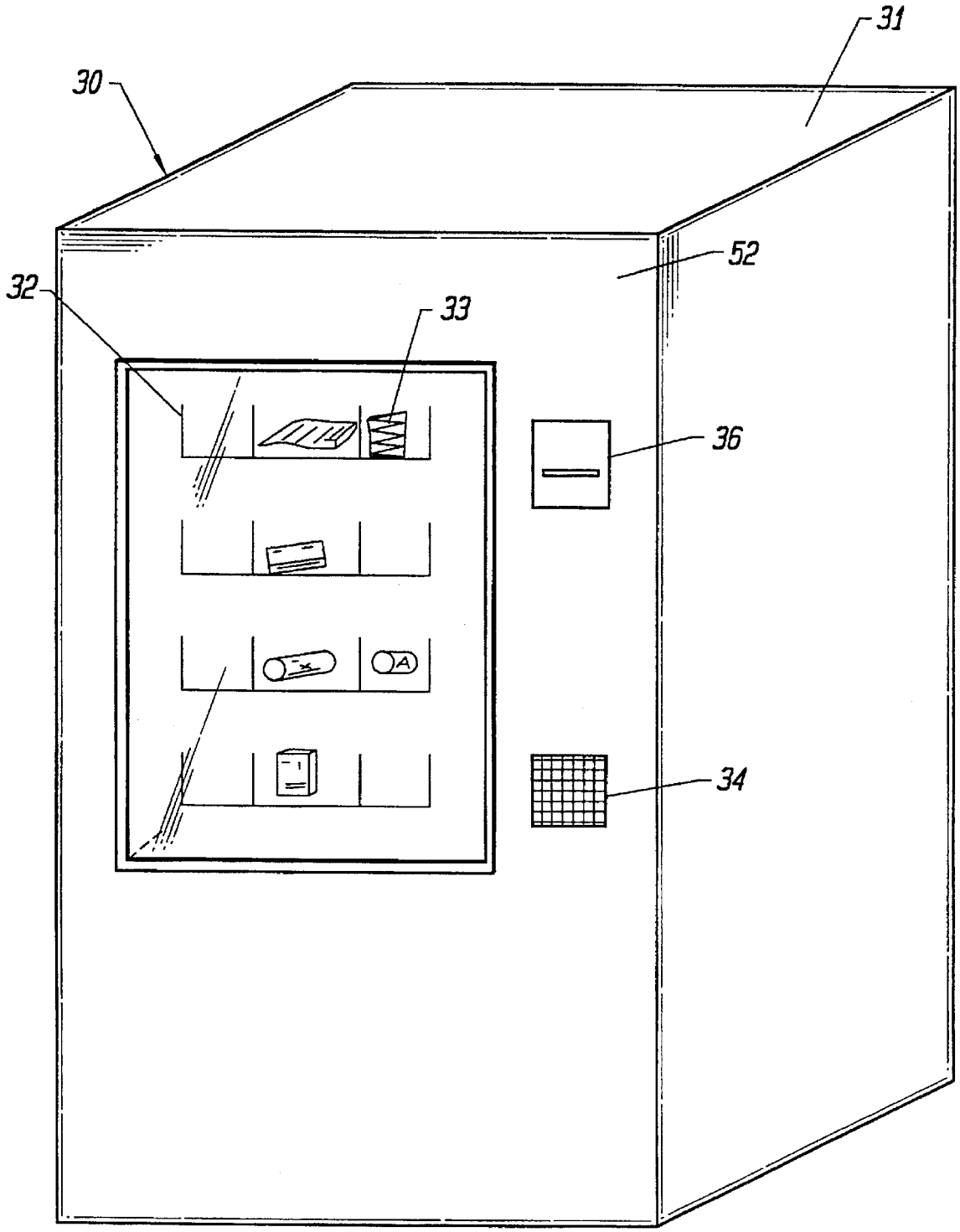
FIG. 5 is an illustration which shows an embodiment of the invention which includes neither a coin acceptor nor a bill validator.
Figure 6:
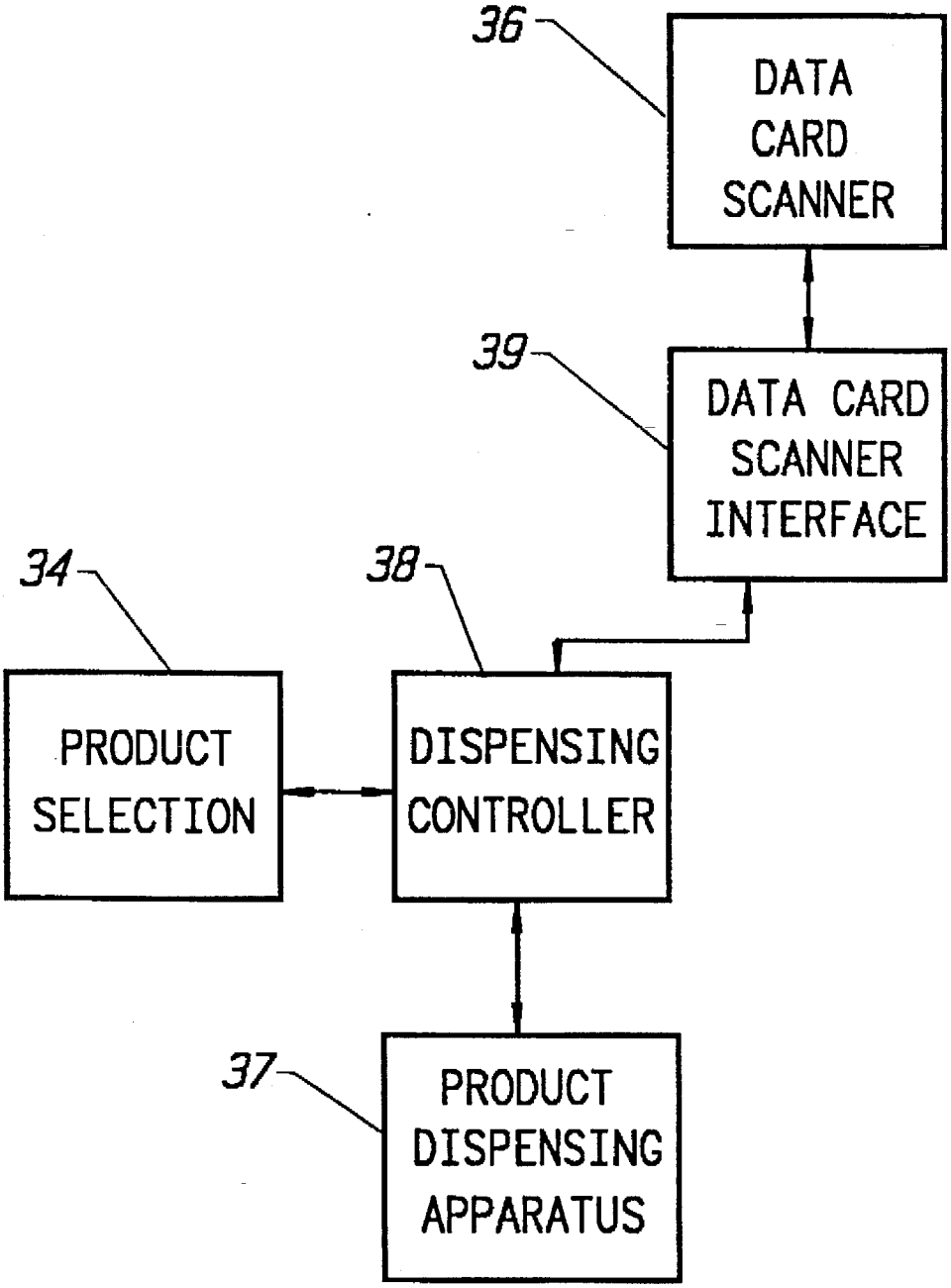
FIG. 6 is an illustration which shows the connectivity of the elements of the embodiment of the invention shown in FIG. 5.
Figure 7:
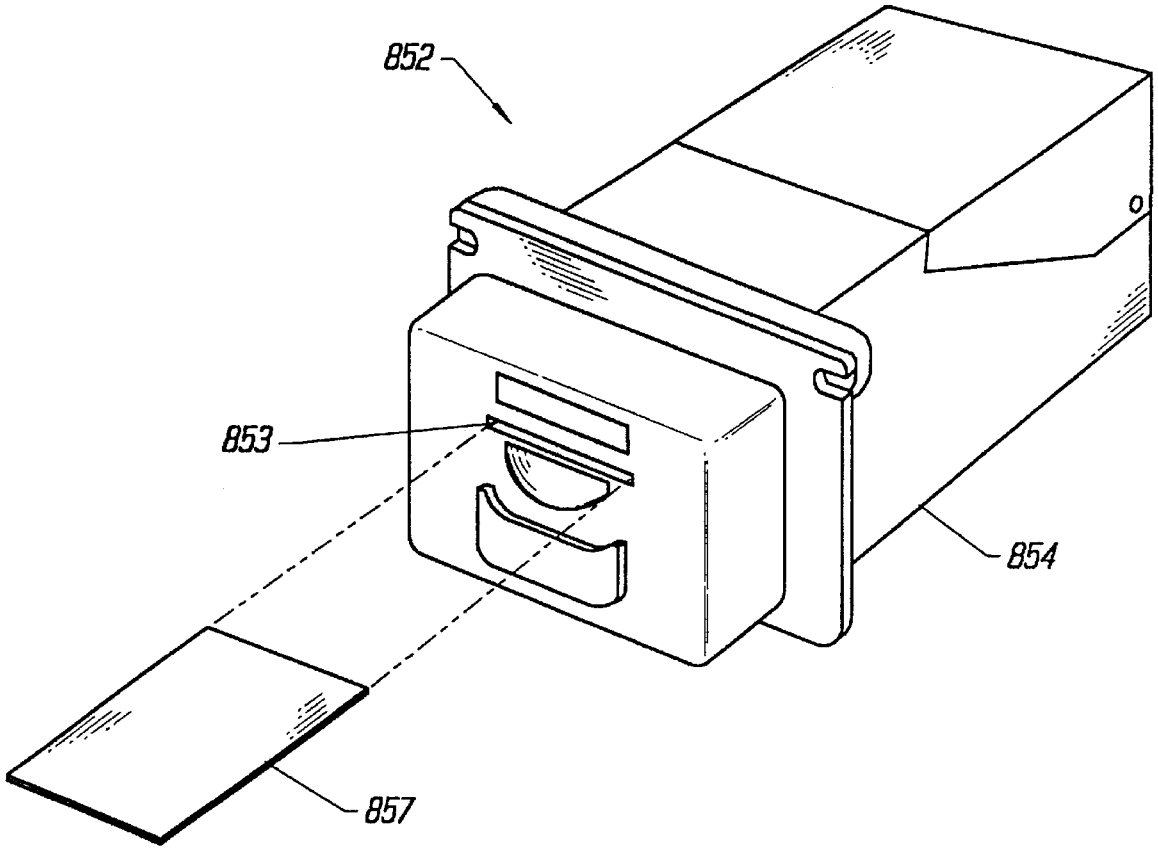
FIG. 7 is an illustration which shows an embodiment of a data card scanning apparatus suitable for use in the present invention.

The dispensing machine elements and their connectivity are illustrative of a possible method of connection. Other elements may be added, and the connectivity altered without departing from the scope of the invention. Some elements may also be removed without making the system inoperable. For example, the bill validator 41 and/or the coin acceptor 35 may be eliminated from the dispensing machine system without effecting the operability of the vending machine through the data card scanner 36. Such operation may be desirable if a cash free installation is desired or represent an operable resulting configuration in the event of a failure of either the bill validator 41 or coin acceptor 35. FIG. 5 is an illustration which shows an embodiment of the invention which includes neither a coin acceptor 35 nor a bill validator 41. The connectivity of the elements is illustrated in FIG. 6. A detailed description of the several elements and their connections as incorporated into an embodiment of the invention will be described subsequently.

The individual elements identified in FIGS. 1 through 6 are described so that their function in the invention and their interrelationship is made clear so that a subsequent detailed discussion of the embodiments of the invention may be more easily understood.

A coin acceptor 35 may be incorporated into the dispensing machine embodiments of the present invention to process coins presented to the dispensing machine by a customer. This function has conventionally been accomplished by an apparatus variously termed a coin acceptor, a coin machine, or coin changer; but the invention is not limited to these conventional coin acceptor apparatus. No particular distinction between a coin acceptor, coin machine, or coin changer is intended by the use of a particular term; they are equivalent in most contexts. An example of a commercial coin changer 35 is the MC5 line of coin changers manufactured by Mars Electronics.

In a conventional vending machine, a coin acceptor 35 is an apparatus which is capable of receiving coins, or coin like tokens, from a dispensing machine customer; processing the coin inputs so as to determine the validity and value of the coins and a total monetary deposit; providing information relating to the coins received to the product or service access mechanism of the machine; and when a sufficient deposit has been made to signal a product dispensing portion of the machine to actuate the service or dispense the product; providing change to the vending machine user, based on its own determination of the change due or based on information from another source such as a vending machine controller.

Inclusion of a coin acceptor 35 as an element of the embodiments of the invention may be advantageous although it is not required in all embodiments of the invention. One advantage is that in spite of higher priced and more sophisticated product offerings, dispensing machines generally continue to offer some products which may reasonably be purchased by pocket change. A second advantage is the ability of an embodiment of the invention to take advantage of the presence of an existing coin acceptor 35 interface so as to reduce any modifications that may be necessary to incorporate a data card scanner 36 in a dispensing machine.

It should be noted, that the coin acceptor 35 itself need not be present for the operation of some embodiments of the invention. It is only necessary that the vending machine support the coin acceptor interface 39 so as to be compatible with the data card scanner 36 interface. In particular, it may be desirable to maintain a cash free vending machine operation by eliminating the coin acceptor 35 and the bill validator 41. The use of the coin acceptor 35 in the overall dispensing machine system concept will be described in detail with regard to the element interfaces.

The embodiment of the present invention illustrated in FIGS. 3 and 4 comprises a means for accepting bills 41.

Such a means for accepting bills 41 may be implemented with a conventional apparatus generally referred to as a bill acceptor, bill changer, or bill validator. This description adopts the language bill validator 41 because this terminology is generally applied by workers in the field. No distinction between bill changer, bill acceptor, bill validator, or similar terms such as currency changer, is intended. The invention need not incorporate a bill validator 41, and where cash free operation is desired, a bill validator 41 need not be provided. It also need not be provided where it is more desirable to configure a data card scanner 36 than a bill validator 41, and where space is limited to provision of one or the other. Where a bill validator 41 is present, the invention encompasses the use of means for accepting bills 41 other than the conventional bill validator 41 so long as the other requirements described herein are satisfied.

A conventional bill validator 41 generally comprises a device which transports an item of paper currency presented at the outside of the device at a bill receiving aperture 42, into the interior of the device for validation. Once the item is validated as being authentic and of proper value, it is retained by the device and either a monetary credit of equivalent value is reserved in some memory storage usable for a subsequent purchase, or when integrated with a coin dispenser apparatus, may provide coins to the customer in an amount equal to the value of the paper currency. Other embodiments of a bill validator 41 are applicable to the present invention.

The vending machine industry has attempted to standardize many attributes of the vending machine apparatus. Most conventional bill validator 41 units adopt industry standard characteristics, including dimensions and electrical interfaces which permits substitution of different bill validator 41 models, either made by the same or different manufacturers, into a dispensing machine.

While the internal structure of the bill validator 41 may generally differ among models or manufacturers, they generally have similar external and electrical characteristics so that substitution between models is possible. Mechanically, they are generally made to be mounted to a front panel 52 of a dispensing machine 30 with all or a substantial portion of the bill validator 41 unit projecting into the interior of the dispensing machine. One of the ends of the bill validator 41 projects through a hole in a front panel 52 in the dispensing machine 30 where a customer may access it by presenting currency bills to a bill receiving aperture 42 for validation and acceptance.

Conventional vending machines have some means to control the dispensing of a product 38. In the simple machines, such as a machine dispensing a single priced product, the dispensing controller 38 may be simple switches and relays. In more complex vending machines such as a machine vending a variety of different priced products, a more complex dispensing controller 38 may be present. A dispensing controller 38 coordinates the actions of the various elements of the dispensing machine possibly including the actions of a coin acceptor 35 and a product dispenser apparatus 37.

The invention is compatible with vending machines having different dispensing controller 38. Different machines may require different scanner interfaces 39 and firmware and/or software changes in the data card scanner 36. Some of the embodiments of the present invention comprise a dispensing controller 38 which are responsive to data structures and control signals selected from a group of standard interface protocols such as MicroMech, MC5000, TRC6000, MC5, or variants thereof. There is also a comparable standard for debit card devices. Some of these standards are promulgated by the National Automatic Merchandising Association (NAMA). The contents of the MC5000, TRC-6000, MC5, and MicroMech standard specifications, which are equivalent in their essential features, are incorporated by reference into this application. The coin acceptor 35, bill validator 41, data card scanner 36, and a scanner interface 39, may be more completely understood by making reference to these standard interface specifications.

Other embodiments of the invention are compatible through the use of different data card scanner interfaces 39, firmware, and software adapted for the signal requirements of single-price, four-price, and ten-price machines. The single-, four-, and ten-price machines do not utilize a separate vending machine controller, nor do they utilize the MC5, MC5000, TRC-6000, or MicroMech standard signals. However, the signals required for operation of these machines is relatively simple and are readily generated by the data card scanner controller or controller and scanner interface.

The modular data card scanner 36 of the present invention is applicable to several types of existing vending machines. These applicable machines comprise vending machines denoted single-price, four-price, ten-price, multi-price and MicroMech machines. The configuration and operation of these conventional machines may be found in publications by MARS Electronics, a major supplier of vending machine components. In particular, the contents of the "Installation, Operation & Service Manual for MC5 Coin Changers" published by MARS Electronics is incorporated by reference into this application. The Manual is supplied to purchasers of Mars equipment and is widely available to workers in the field.

When a data card scanner 36 and scanner interface 39 are interposed between a coin acceptor 35 and a vending machine dispenser controller apparatus 38, appropriate signals must be passed through the interface (or be received and regenerated) or generated within the scanner 36 or scanner interface 39. The conventional signal requirements of several types of vending machines; such as single-price, four-price, ten-price, multi-price, and MicroMech type vending machines, for example; are known in the art.

Other coin acceptor 35 to vending machine standards may exist or be developed in the future. The critical point is that all the coin acceptors 35 generate or respond to a limited number of signal lines. The coin acceptor 35 unit is not required for operation if the proper generation and response between the coin acceptor 35 and the vending machine, or the coin acceptor 35 and a vending machine controller 80 is supplied by a non-currency substitute unit. The modular data card scanner 36 provides these signals.

Each of the several embodiments of the invention comprises a data card scanner 36. The incorporation of a data card scanner 36 into the vending machine system advantageously solves many of the problems associated with conventional coin, paper currency, and bank credit card type unattended vended sales. The data card scanner 36 can be implemented by incorporating various information storage and retrieval technologies. These options include, but are not limited to, magnetic reader/writer scanning units and optical reader/record scanning units.

In one embodiment of the invention, the means for data card scanning is implemented with a data card scanner 36 apparatus such as that illustrated in FIG. 31, for example.

This data card scanner 36 incorporates a linear scanning mechanism and is completely described in U.S. patent application U.S. patent application Ser. No. 07/777,736, filed on Oct. 11, 1991 and incorporated by reference herein, which is copending with this application. Alternatively, the data card scanner 36 may be realized by incorporating a rotary scanner, for example, which is completely described in U.S. patent application Ser. No. 697,944 filed May 9, 1991. This scanner incorporates a rotary scanning mechanism. The respective linear and rotary scanner applications also disclose the structures of a data cards used in conjunction with the respective data card scanner 36, including there information storage structures and operation.

While the inclusion of a data card scanner 36 in a vending machine need not be in an add-on or retrofit embodiment, a scanner 36 capable of retrofit installation has advantages which contribute to satisfying the needs unsolved by conventional systems. The data card scanner 36 comprises several features which provide its modular retrofit capabilities. Its scanning mechanism is mechanically modular, the scanner hardware is compatible with a broad class of applications, the electrical scanner interface 39 hardware to the vending application is relatively simple and can be simply changed, and the firmware can be selected and configured by a minimum of field programming during data card scanner and interface installation. A data card scanner having overall dimensions of approximately 6.4 by 3.42 by 5.22 (L, W, H) inches has the appropriate geometrical form factor to be accommodated into a standard bill validator vending machine slot.

Figure 8:
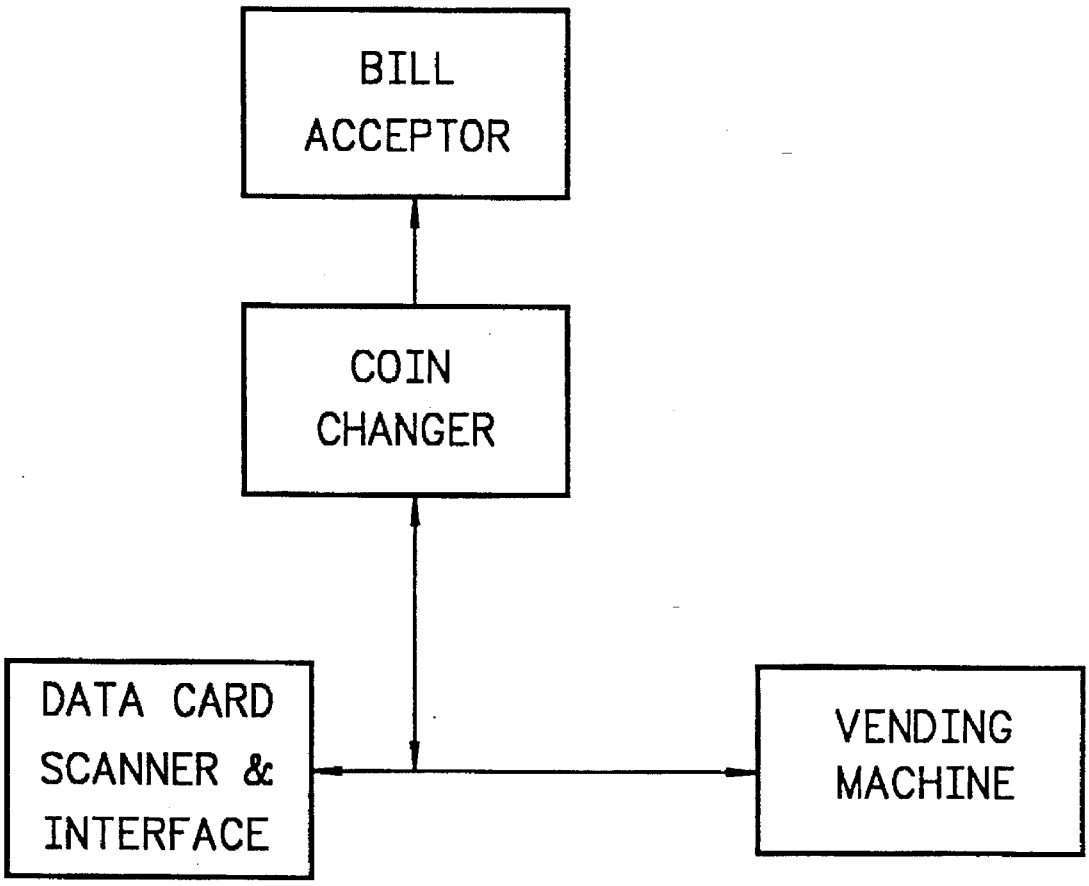
FIG. 8 is an illustration which shows a block diagram of the elements and connections between elements of a vending machine system according to this inventions, which does not utilize a separate vending machine controller.

In reference to FIG. 8 there is illustrated a block diagram of a vending machine system according to one embodiment of this invention, which does not utilize a separate controller. This type of system has been described in the context of single-, four-, ten- and multi-priced vending machines. This figure illustrates that the modular replacement data card scanner 36 and scanner interface 39 supplies and receives signals to and from the vending machine in conceptual parallelism to the coin changer 35. The actual interface 39 described below, provides for some isolation between the two sets of signals so that they are not actually electrically wired together. The parallelism may also be accomplished by passing the coin acceptor 35 signals through the data card scanner interface 39. The signals required for operation of the single-, four-, ten- and multi-priced vending machines are known in the art. Embodiments of scanner interfaces 39 for these machines will be described subsequently.

Figure 9:
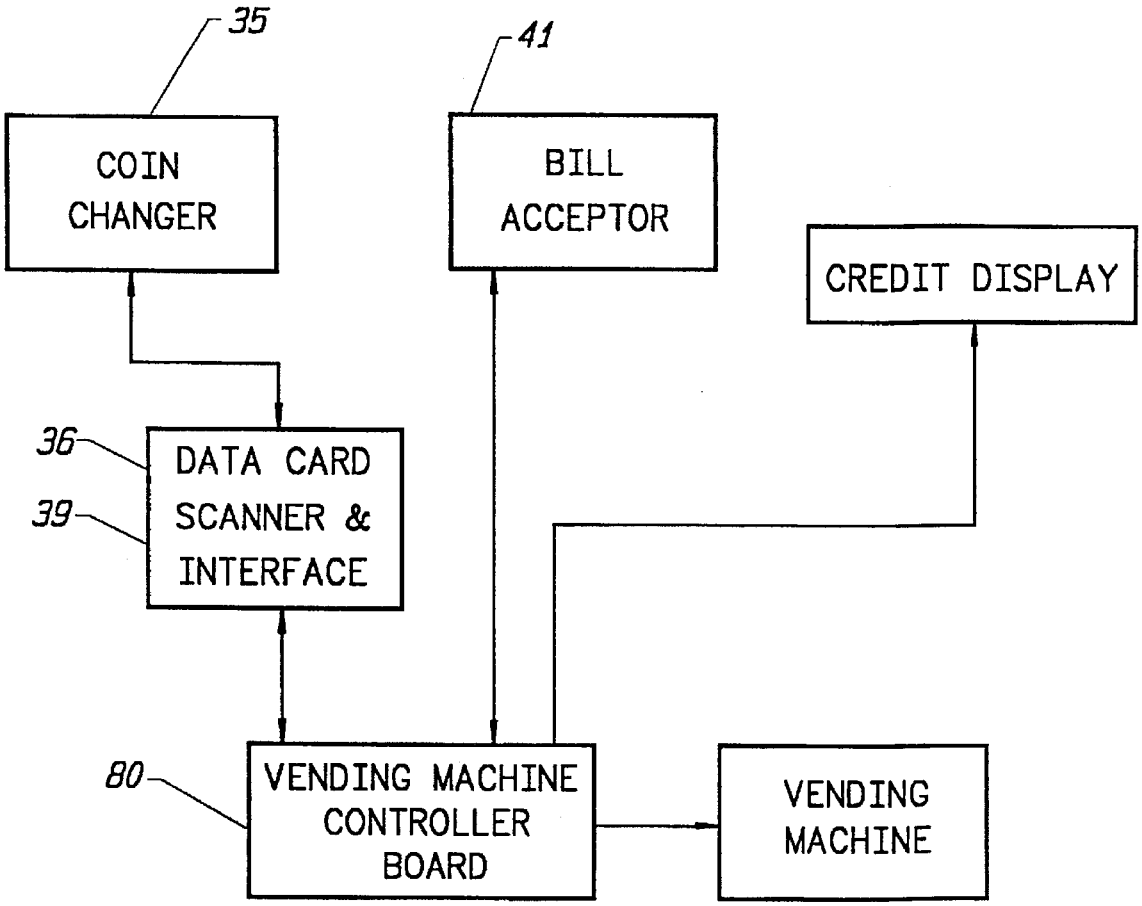
FIG. 9 is an illustration which shows a block diagram of the elements and connections between elements of a vending machine system according to this inventions, which utilizes a separate vending machine controller.

In reference to FIG. 9 there is illustrated a block diagram of a vending machine system according to another embodiment of this invention which utilizes a separate controller; such as the MicroMech based system. In this type of system, the modular data card scanner 36 and scanner interface 39 are interposed between the coin changer 35 and the controller board 80 of the vending machine system. While the connections are made to the scanner interface 39, the data card scanner which contains the scanner controller and firmware are also effectively interposed because the data card scanner controller communicates with the scanner interface 39.

Figure 10A:
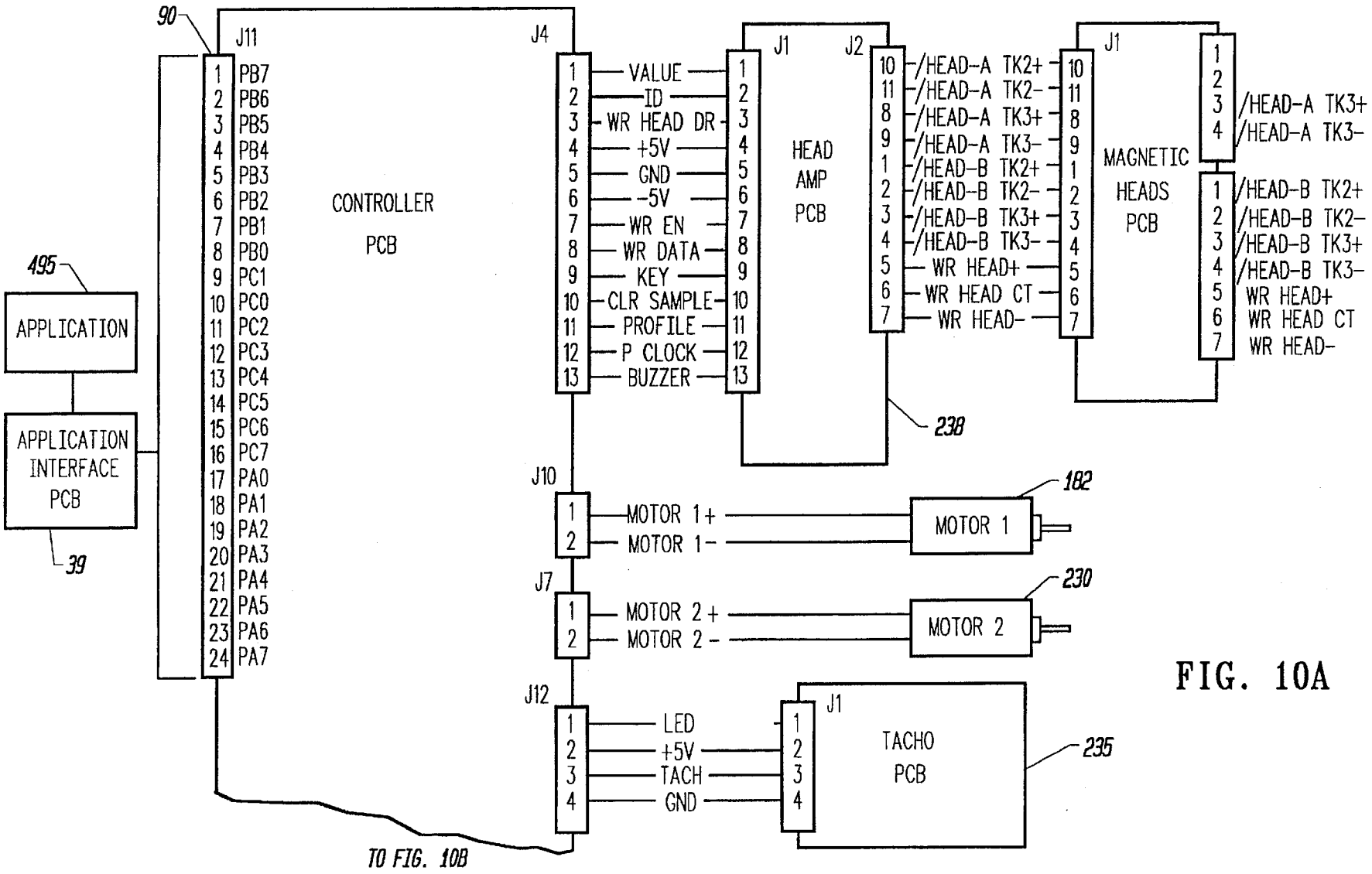
FIG. 10 is an illustration which shows an interconnection diagram of an embodiment of a Scanner Apparatus Controller PCB for a data card scanner interface which supplies the signals necessary for either single-price vending machine applications or a multi-price vending machine applications.
Figure 10B:
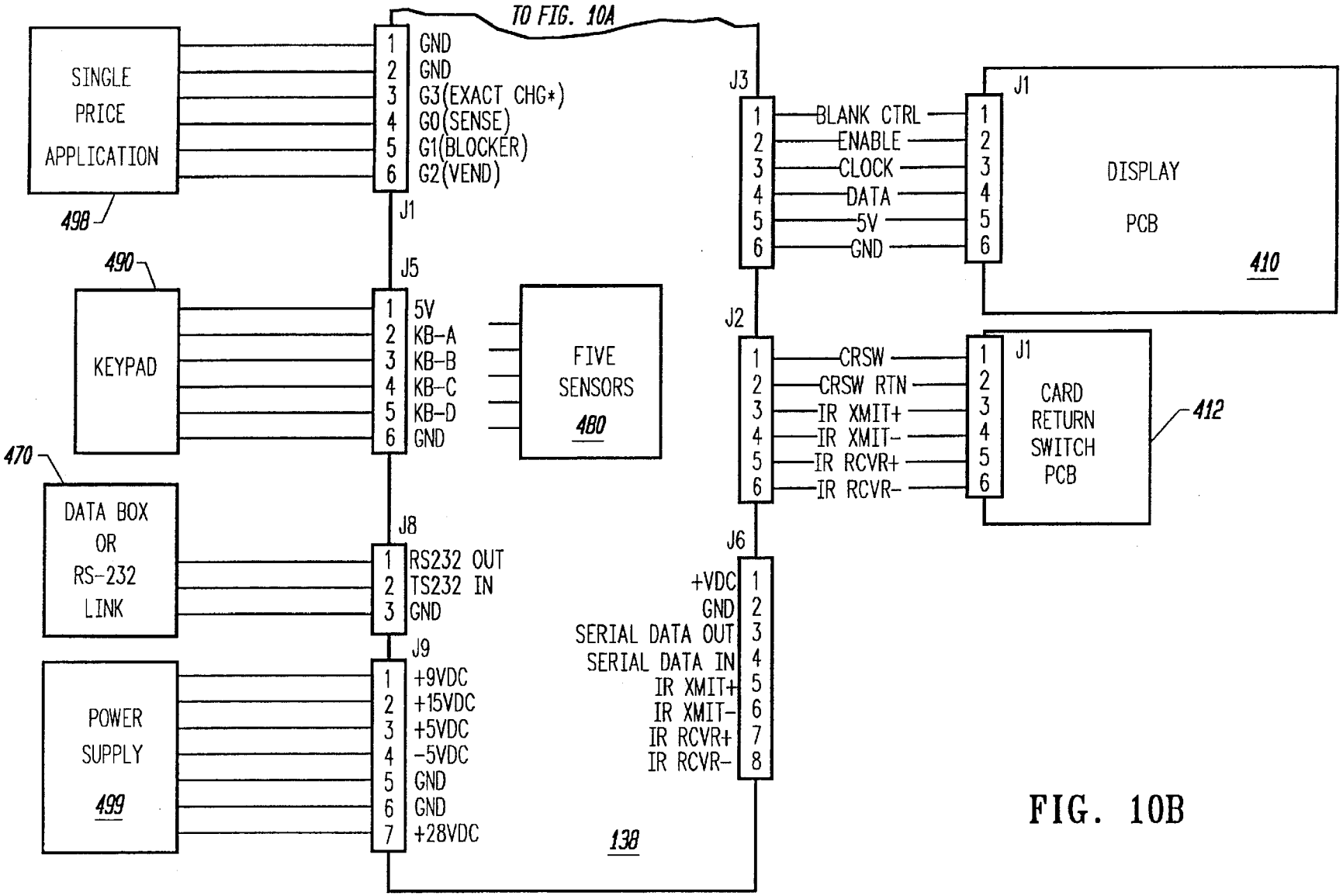

In reference to FIG. 10 there is illustrated an interconnection diagram of an embodiment of a data card scanner interface controller PCB 138 for an embodiment of a linear data card scanner 36 as disclosed in U.S. patent application U.S. patent application Ser. No. 07/777,736. This figure diagrammatically illustrates scanner controller elements which supply the signals necessary for either a single price vending machine or a multi-price vending machine.

For a single price vending machine, the Controller PCB 138 is configured to provide the required signals for a single price application 498 and provides six signals via connector J1: an Exact Change line, a Sense line, a Blocked line, a Vend line, and two ground lines. In the context of the general discussion of the data card scanner interface 39, the single-price application 498 is equivalent to the scanner interface 39.

For a vending machine involving a more complex pricing system, there may be need to communicate with an application scanner interface 496 which provides the signals necessary for operation of the particular vending machine application. In this more detailed diagram, the application interface PCB is equivalent to the data card scanner interface 39 previously described in more general terms. The four-, ten-, and multi-price machines, and the MicroMech vending machines are examples of such complexity. The MicroMech application allows a consumer to select one of a number of goods from a vending machine having a multiplicity of prices for different items. This application may require up to 24 input/output ports which the scanner controller PCB 138 provides.

Figure 11A:
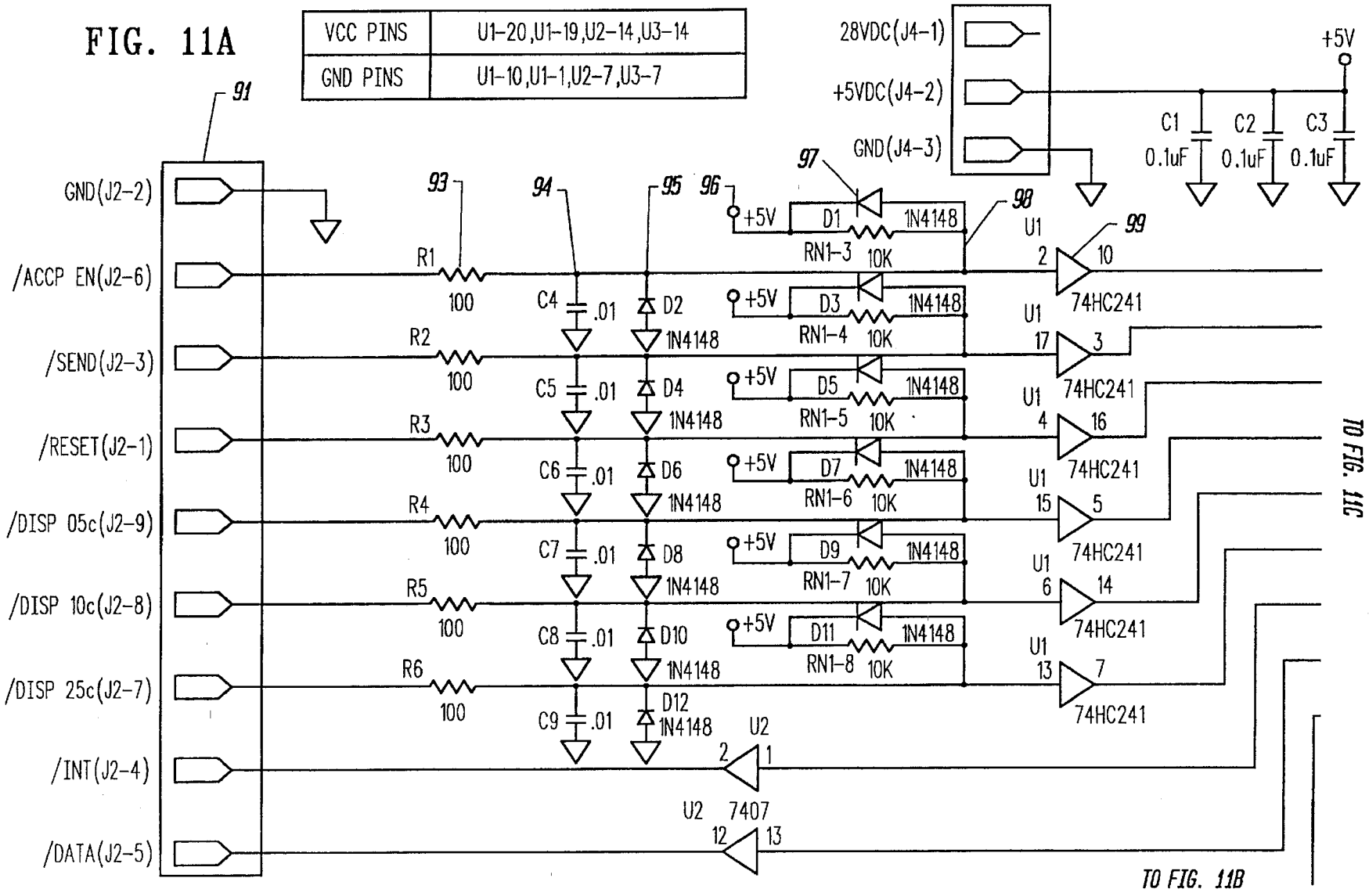
FIG. 11 is an illustration which shows how the scanner interface may be interposed between a coin acceptor and a vending machine controller board for a MicroMech type vending machine.
Figure 11B:
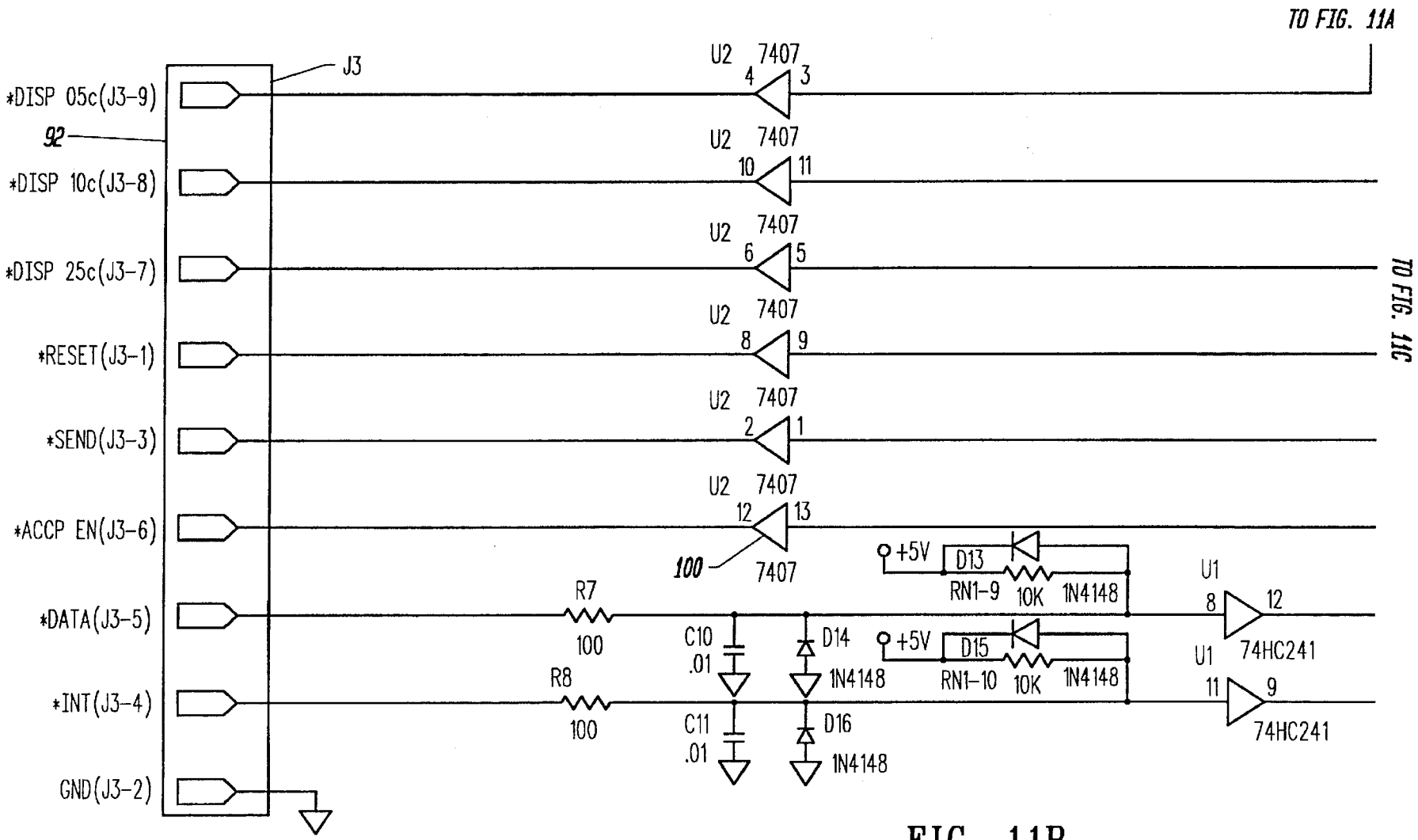
Figure 11C:
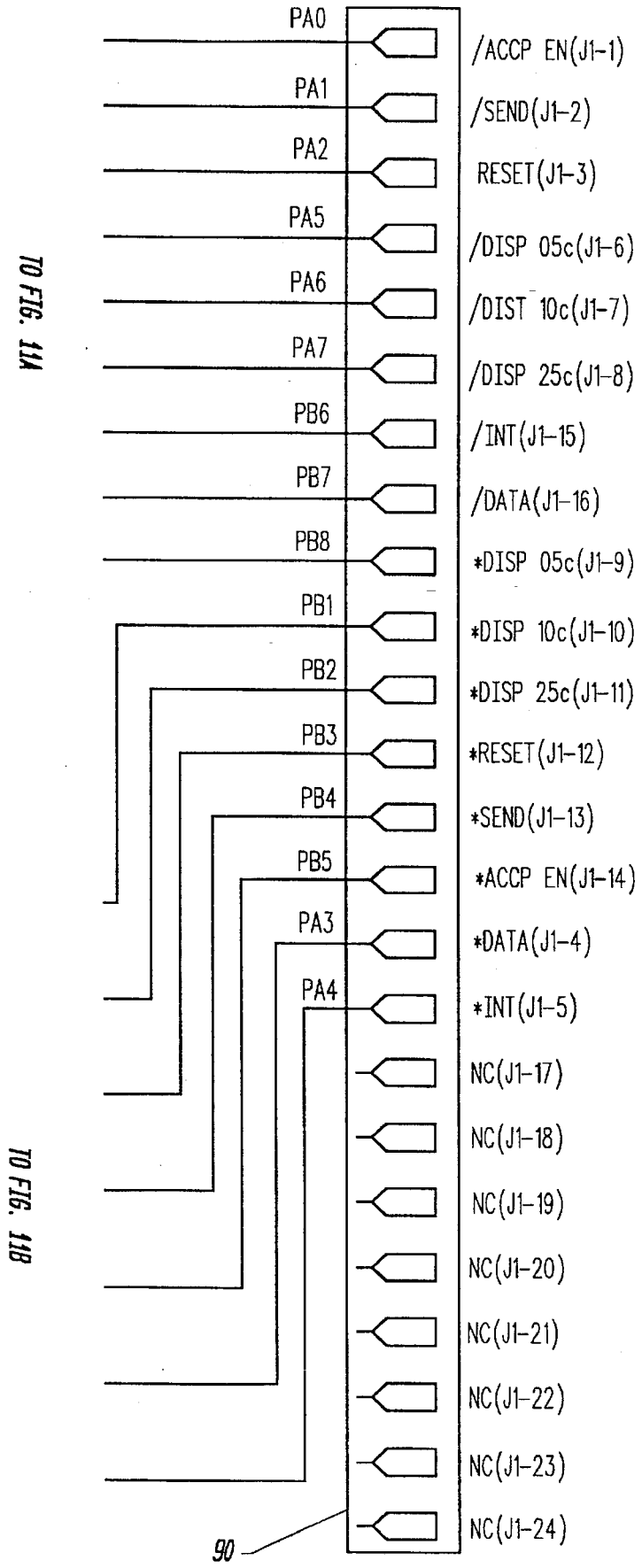

By way of example, FIG. 11 illustrates how the scanner interface 39 may be interposed between a coin acceptor 35 and a vending machine controller board 80 as illustrated diagrammatically in FIG. 9. In FIG. 11 there is shown a Scanner Interface Controller PCB port 90, a Scanner Interface-to-Vending Machine Controller port 91, and a Scanner Interface-to-Coin Acceptor port 92. This illustration diagrammatically illustrates an embodiment of how the scanner interface 39 may be interposed between the coin acceptor 35 and the vending machine controller. Proper male/female plugs, are provided so as to allow the coin acceptor 35 to be unplugged from the vending machine controller 80 and plugged into the scanner interface 39, and then the scanner interface 39 may be plugged into the vending machine controller 80.

The Scanner Interface Controller PCB port 90 is also illustrated in FIG. 10. This port transmits and receives signals form the vending machine controller 80 and a coin acceptor apparatus. The signals present at the scanner interface controller port 90 are the/ACCEP EN, /SEND, RESET, /DISP 05*c*, /DISP 10*c*, /DISP 25*c*, /INT, /DATA, *DISP 05*c*, *DISP 10*c*, *DISP 25*c*, *RESET, *SEND, *ACCP EN, *DATA, and *INT. Other scanner interface controller ports are not used for this interface application.

The vending machine controller transmits the/ACCEP EN,/SEND, RESET,/DISP 05*c*,/DISP 10*c*,/DISP 25*c*,/INT, and/DATA signals to the scanner interface controller port 90 by way of electrical lines incorporating signal conditioning and circuit protection circuitry. Each signal passes through a resistor 93, and has some capacitive filtering provided by a capacitor 94 to ground, a diode 95 is in parallel to the capacitor 94. Pull-up resistors 98 are connected to a +5 volt supply 96, and in parallel to a diode 97. Amplifiers 99 are also provided in the signal path. These signal conditioning and protection components are provided because of the potentially uncertain load or signal characteristics of the vending machine controller. The ground form the vending machine controller is not transmitted over the interface to the scanner interface controller ports 90.

The *DISP 05*c*, *DISP 10*c*, *DISP 25*c*, *RESET, *SEND, *ACCP EN, *DATA, and *INT signals are communicated between the scanner interface controller 90 and the coin acceptor ports 92. The *DATA and *INT are communicated from the coin acceptor ports 92 to the scanner interface controller ports 90 and are provided with signal conditioning and protection circuitry as described above. The rest of the signals are sent by the interface controller to the coin acceptor ports 92 have only an amplifier 100 in the signal path. The ground from the coin acceptor port 92 is not communicated to the scanner interface controller ports 90.

Figure 12:
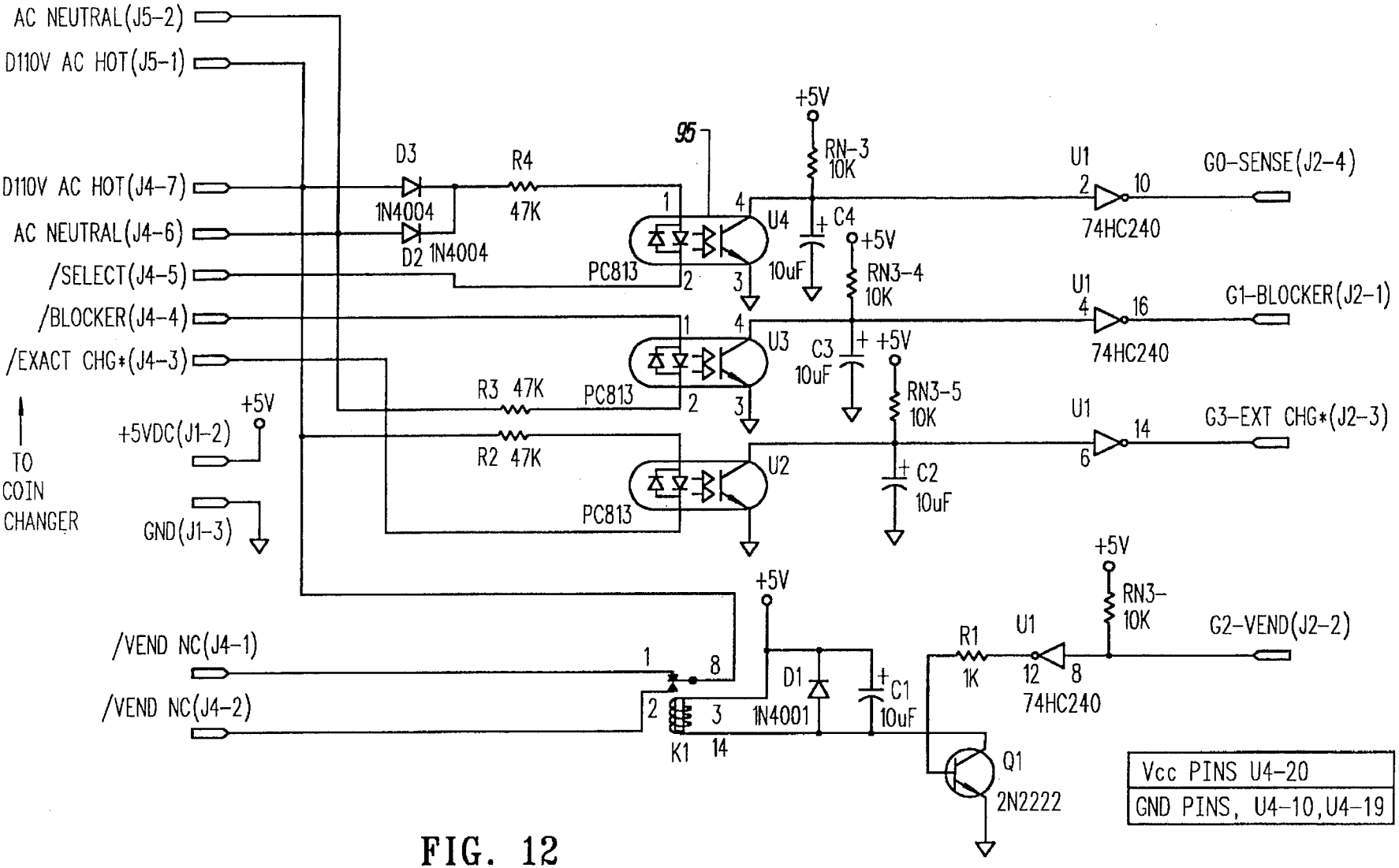
FIG. 12 is an illustration which shows an interface for a single-price vending machine application.
Figure 13A:
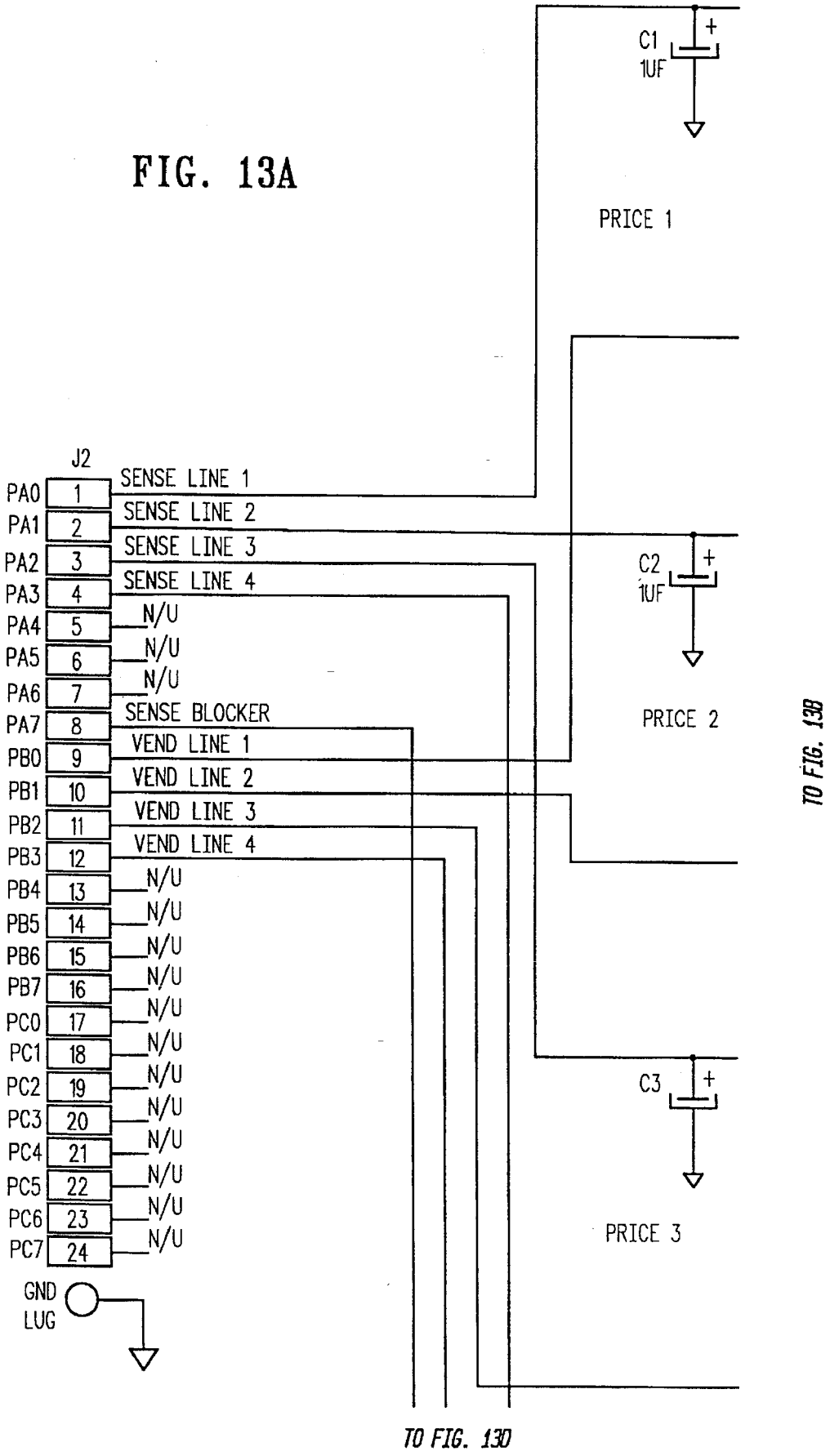
FIG. 13 is an illustration which shows an embodiment of a scanner interface for a four-price vending machine application.
Figure 13B:
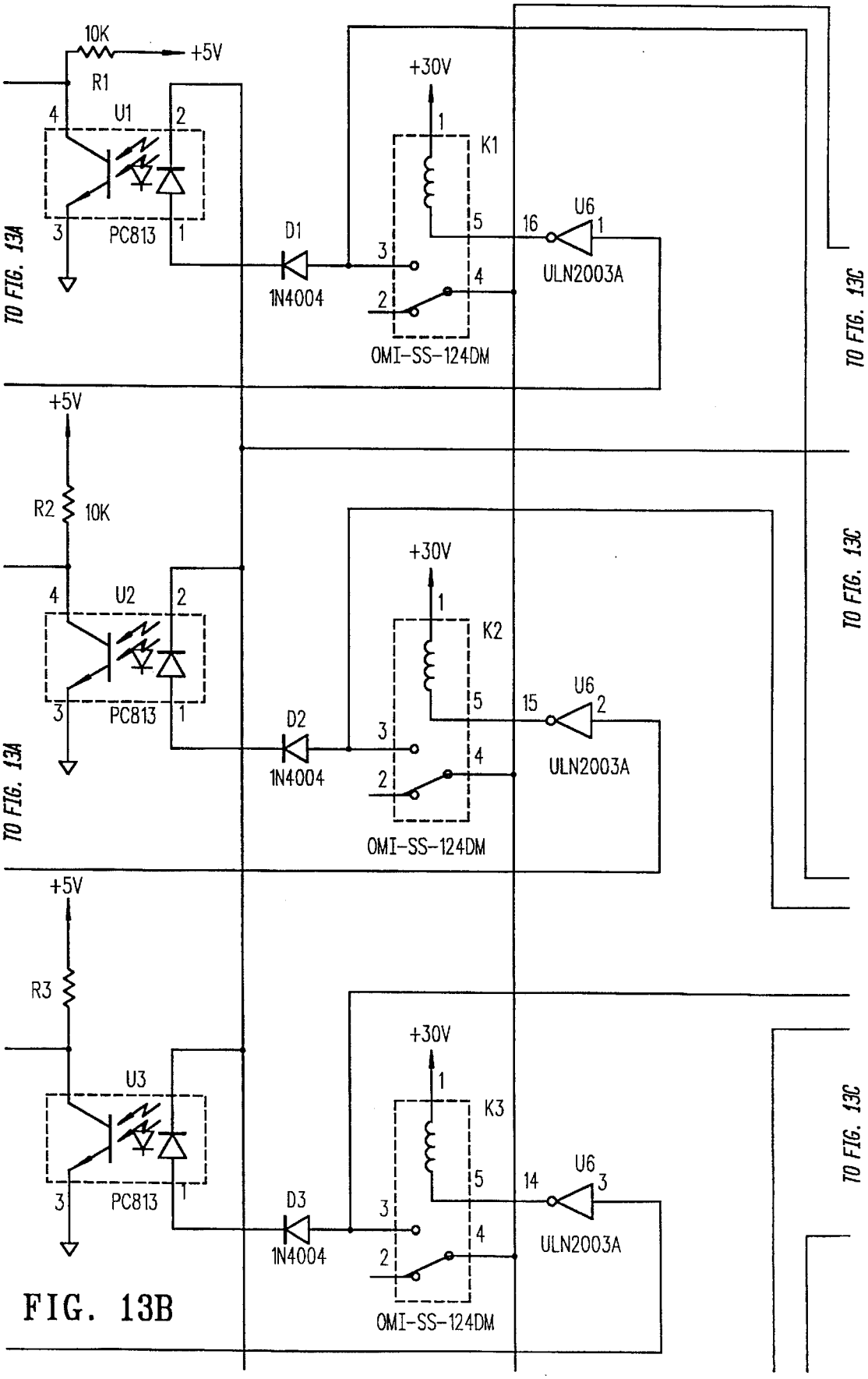
Figure 13C:
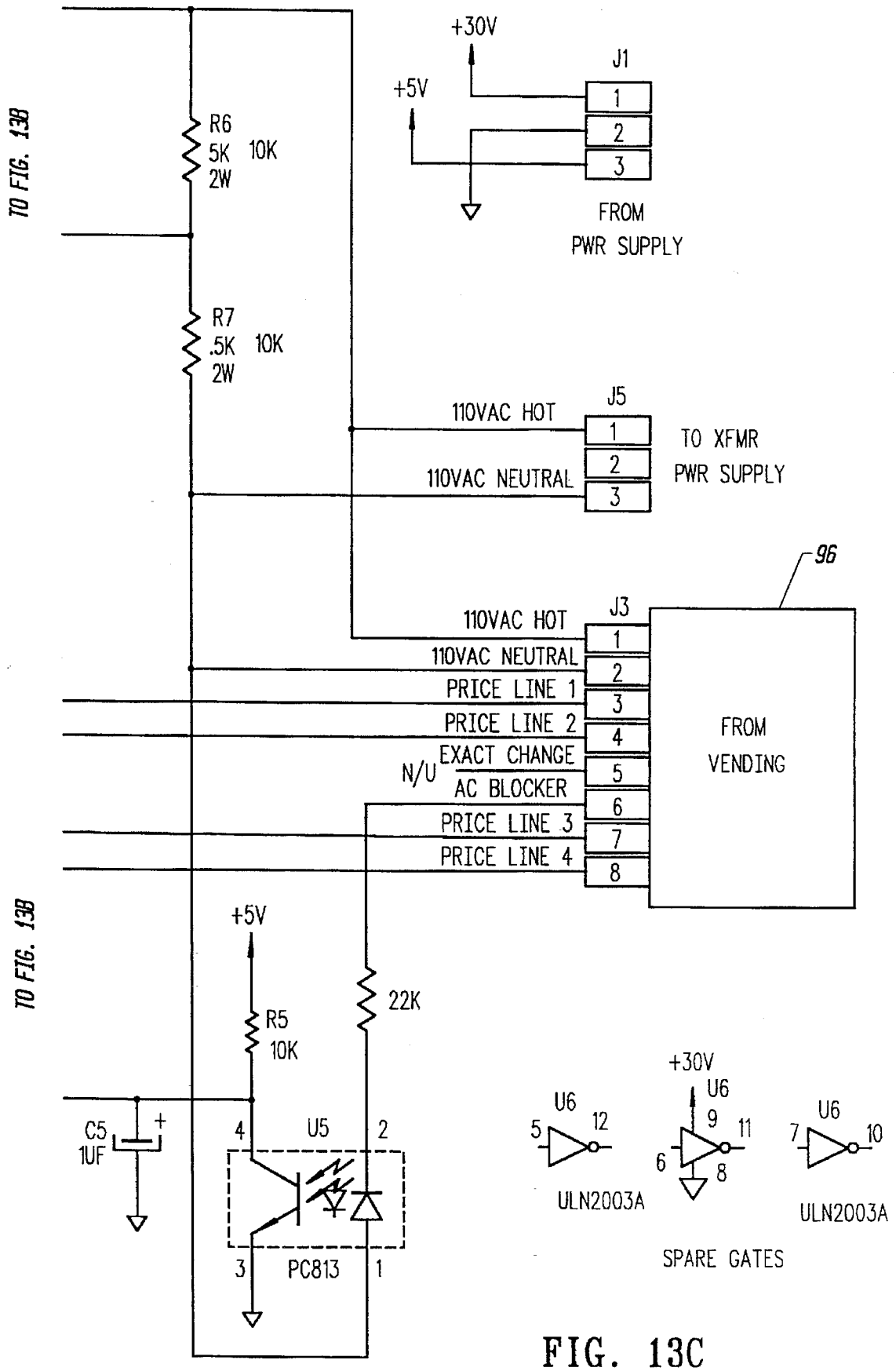
Figure 13D:
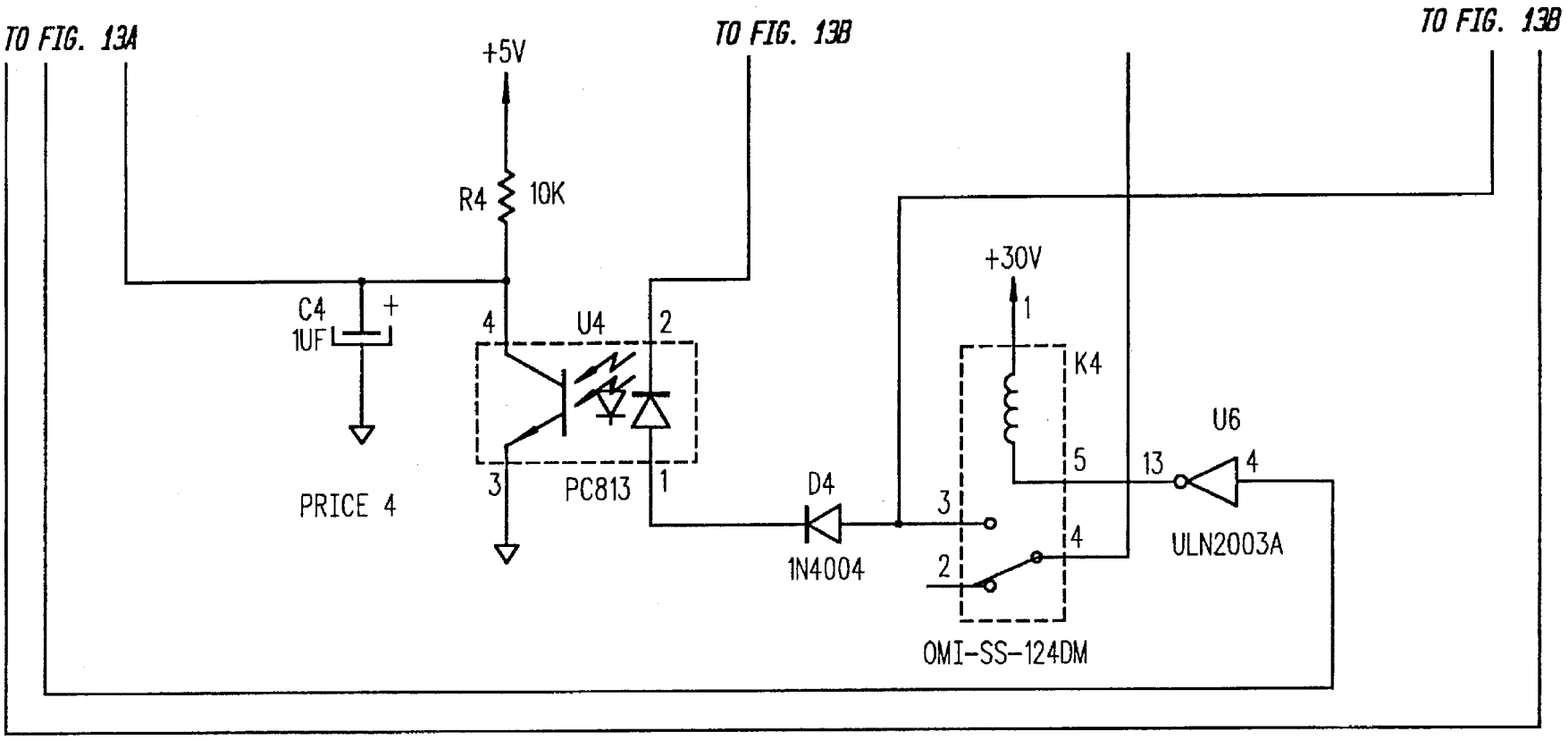

FIG. 12 is an illustration which shows a scanner interface 39 for a single-price vending machine application. The conceptual parallelism between the coin changer 35 and the data card scanner 36 is achieved by inputting the signals from the coin changer 35 to the scanner interface 39. Signals to the product dispensing apparatus 37 can then be generated by either the coin changer 35 or the data card scanner 36. Optical isolation 95 between the coin changer 35 and the signal generation portion of the scanner interface 39 is used to provide electrical isolation while permitting the signal information to be transmitted.

FIG. 13 is an illustration which shows an embodiment of a scanner interface 39 for a four-price vending machine application. The data card scanner controller 138 communicates with the scanner interface 39 through four sense lines, four vend lines, and one sense blocker line. The scanner interface 39 communicates with the vending machine 96 through four price lines and one blocker line. Electrical power is also supplied to the vending machine dispense portion through the scanner interface 39 and power supply.

While the previous discussion and diagrams illustrated the electrical scanner interface 39 and connections for single-price, four-price and MicroMech systems, it will be clear to a person in the art that the same principles apply to other vending machines, albeit with somewhat different interface electronics and signals. The data card scanner 36 hardware is the same for each of these applications. Only the scanner interface 39 hardware changes between applications, and the portion of firmware, which is integral to the scanner apparatus, to be used in the application is selected by simple field programming during installation. In each case the data card scanner interface 39 in cooperation with the data card scanner hardware, firmware, and software generate electrical signals appropriate to the type of vending machine in which it is installed when the card indicates that proper payment may be accepted from the data card.

An embodiment of the present invention provides for a data card scanner 36 which is modular and has external physical characteristics, including linear dimensions, mounting flanges, weight, and interface connections, such that it may be easily mounted into the space previously occupied by the standard bill validator 41. This retrofit feature may be accomplished without structural modification of the dispensing machine housing 31, including without cutting additional holes. The modular data card scanner 36 may also be installed in a dispensing machine which was designed to incorporate a bill validator 41. In this instance the physical installation, including modifications to the dispensing machine front panel 52, is substantially the same as for a standard bill validator 41.

This modular data card scanner 36 may comprise the linear data card scanner with moving transducer described in U.S. patent application Ser. No. 07/777,736. filed Oct. 11, 1991, or the rotary scanner described in U.S. patent application Ser. No. 697,944 filed May 9, 1991.

Figure 14:
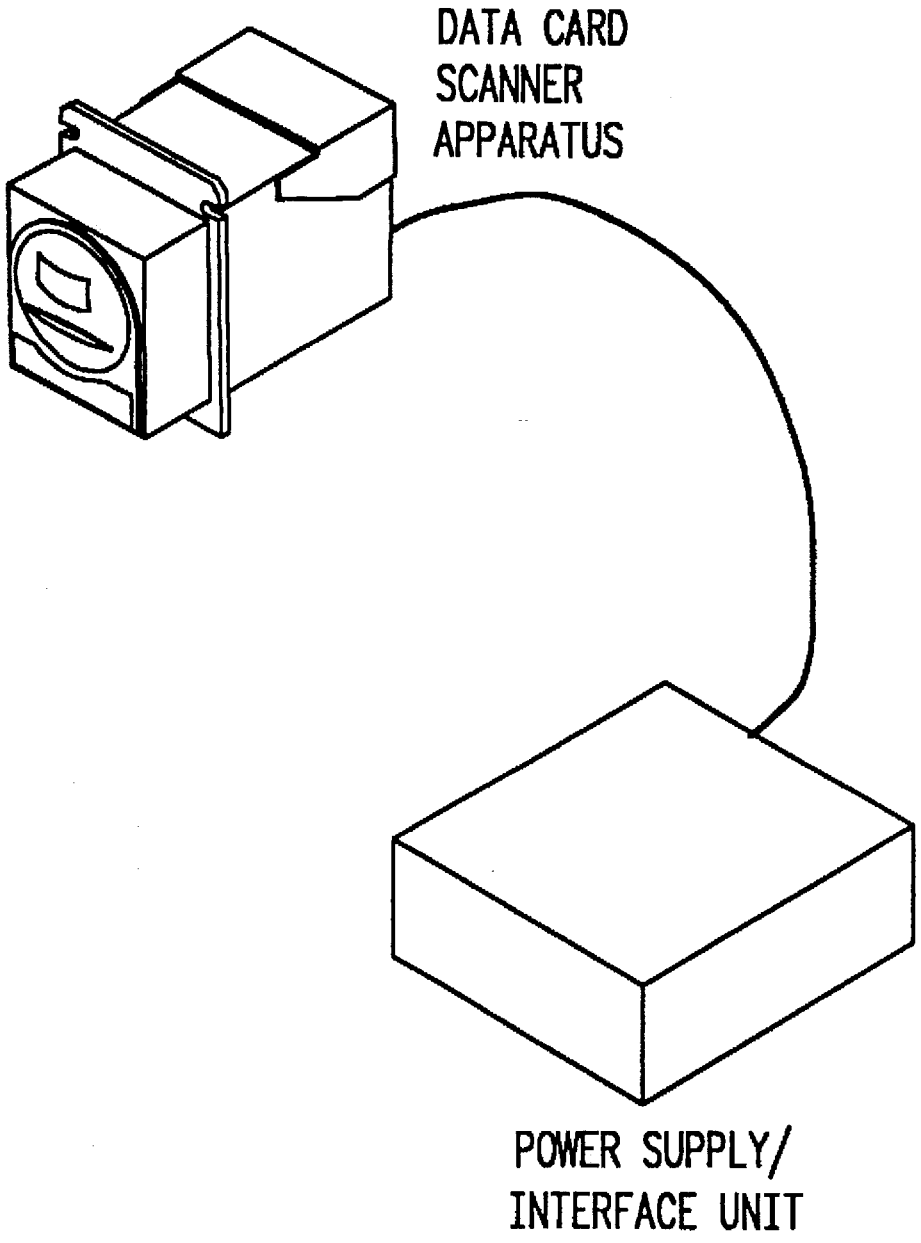
FIG. 14 is an illustration which shows an embodiment the modular data card scanner and the attached power supply and interface unit.
Figure 15:
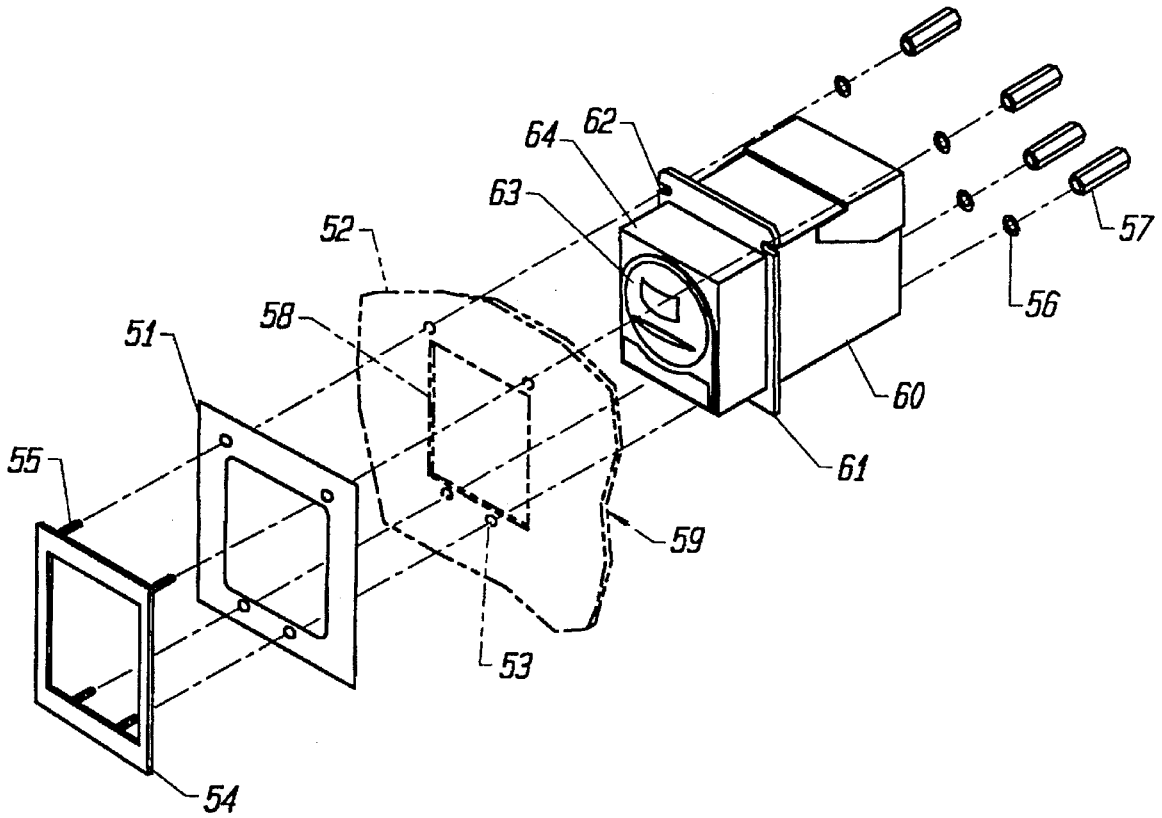
FIG. 15 is an illustration which shows an exploded view of a standard template for the dispensing machine front panel cutout, its mounting hole pattern, and its relationship to an embodiment of a data card scanner.

The modular data card scanner 36 is illustrated in FIG. 14. FIG. 15 is an illustration which shows a standard template 51 for the dispensing machine front panel 52 cutout and mounting hole 53 pattern. FIG. 39 also illustrates the standard mounting bezel 54 which comprises a plurality of threaded fasteners 55 for coupling to a bill validator 41, or in this case to a data card scanner 60 on a interior side 59 of the dispensing machine front panel 52 using a plurality of washers 56 and a plurality of threaded fasteners to mate to threaded fasteners 54.

The particular embodiment of the modular data card scanner 60 comprises a substantially rectangular box 64 wherein are contained the devices and components necessary or desirable for data card scanning operation. One scanner end 63 of the data card scanner 60 projects through a panel in the dispensing machine having a hole 58 so that a customer may access the data card scanning apparatus, and the dispensing machine, by presenting a data card. A mounting flange 61 surrounds four sides proximate the scanner end 63, and has engagement structures 62 to cooperate with the threaded fasteners 55 of the mounting bezel 54 so that the data card scanner 60 may be mounted to the dispenser panel. Other mounting schemes are possible. The actual dimensions of the data card scanner 60 may be different from those of the standard bill acceptor; however, the modular data card scanner 60 will be mountable on a dispensing machine.

The mounting flange 61 of the data card scanner 60 comprises a substantially planar plate 61 of a material with sufficient strength to provide secure mounting and use without sustaining damage. The mounting flange has slots, holes, or other similar structures 62 which are appropriately sized to permit a fastener, such as a threaded screw, to pass through the slot or hole without binding.

A significant feature of the invention is the provision of a means for retaining possession of a data card when the data card is defective or has predetermined characteristics. This capability is referred to as card swallowing and is provided by the data card scanner 36 transport mechanism. This transport mechanism is described in U.S. patent application Ser. No. 07/777,736. filed Oct. 11, 1991 and herein incorporated by reference. One such predetermined characteristic is identification of the card as a promotional use card intended for one-time or limited use. In such cards, the card contains information identifying it as a promotional card. For example, the information encoded in the card may restrict use of the card to the purchase of a particular product or alternately, restrict the purchase to a particular monetary value. Virtually any combination of products, monetary credits, valid use locations, and so on can be encoded in the information so that the promotional card can be tailored to particular products, product discounts, market segments, machines, and so on.

In an embodiment of the invention, the card swallowing feature is integrated with the device that provides a data card scanner 36. A card may be retained within the data card scanner 36 by commands to the data card positioning assembly that moves the card through the scanner apparatus to a receiving location outside of the data card scanner 36 but in the interior of the dispensing machine for later collection, rather than presenting the card to the exterior of the machine for extraction by the user.

In reference to FIG. 14 there is shown an embodiment of a modular scanner with a separate power supply and scanner interface 39 unit separate from the data card scanner apparatus 36. The scanner is connected to the power supply/interface unit by a communication link, which may be a multi-wire electrical cable. Other communication links are possible. In this embodiment the power supply and interface 39 unit are located somewhat remotely from the scanner unit, and may be placed substantially anywhere within the vending machine container where space is available. The cable length may be reasonably extended by the use of additional extension cables where necessary.

While a particular embodiment of the invention has been described in detail, it will be understood that the invention may be implemented through alternative embodiments. Thus, the scope of the present invention is not intended to be limited to the embodiment described above, but is to be defined by the appended claims.

What is claimed is:

1. A payment acceptance apparatus retrofittably adaptable to substitute for a standard bill validator apparatus in a dispensing machine for dispensing products upon user request and payment, said dispensing machine being of a type having a dispensing controller for controlling dispensing of product in response to first electrical signals indicative of an amount of payment accepted by a separate cash acceptance apparatus, a defined control signal characteristic, a dispensing machine interior volume defined by a dispensing machine housing having a surface, said payment acceptance apparatus comprising:

a data card scanning apparatus for scanning a magnetic stripe data card and acquiring cash payment information in the form of second electrical signals and information regarding the identification of said data card as a promotional use card;

said promotional card containing information encoded on said magnetic stripe of said card including information identifying it as a promotional use card and defining advanced features provided to the holder of said card upon acceptance of said card by said scanner apparatus;

means for providing advanced dispensing features including recognition and acceptance of said promotional use cards and provision of special dispensing and payment features in response to said recognition and acceptance, said advanced features including restricting use of said promotional data card to the purchase of a particular product or combination of products, restricting each use by limiting the purchase amount to a particular monetary value independent of the value remaining encoded on said promotional data card, restricting acceptance of said promotional data card to particular vending locations or to particular dispensing machines, and providing a price discount on predetermined products when said promotional card is used for the purchase of the predetermined products and thereby promoting a purchase of said predetermined products by a market segment of the general population for whom the price of said particular items have been attractively reduced without reducing the price of said particular items to the general population by virtue of distribution of said promotional use cards only to said market segment;

said scanner apparatus having height and width dimensions, in a plane of a surface of said dispensing machine housing when said scanner apparatus is inserted in said surface of said dispensing machine housing, and volume dimensions, smaller than or substantially equal to corresponding height and width and volume dimensions of a standard bill validator apparatus so that said scanner apparatus can be positioned within an opening in said dispensing machine designed for said standard bill validator apparatus to substitute for or replace said standard bill validator apparatus;

said scanner apparatus being disposed substantially within said interior perimeter of said dispensing machine housing but extending into said dispensing machine housing to a depth no greater than a depth said standard bill validator apparatus would extend;

means for interfacing said second electrical signals with said dispensing controller of said dispensing machine to indicate proper payment, said means for interfacing being reconfigurable to receive said second electrical signals and to generate and transmit third electrical signals to said dispensing machine which are specially adapted to said defined control signal characteristics of said dispensing machine;

said data card scanner apparatus and interface generating and coupling said second and third signals to said dispensing machine in substitution of said first electrical signals without either a bill validator apparatus or a coin acceptor apparatus connected to said dispensing controller or to said scanner apparatus;

means for swallowing said data card when said data card has predetermined characteristics including identification of said card as being defective and identification of said card as a promotional use card when the advanced dispensing feature(s) provided by that promotional card has been used up and independent of any remaining cash value present on the card or of the physical condition of the card; and means for tracking the purchase patterns of consumers by collecting said swallowed promotional use cards having the nature of said card encoded upon the magnetic stripe of the card and tabulating the geographical distribution of said promotional card use;

whereby said payment acceptance apparatus is retrofittable to and electrical signal compatible with said plurality of different dispensing machine types.

2. In a dispensing machine for dispensing products or services, said dispensing machine being of the type having:

a housing defining an enclosed vending machine interior space and volume and having a first surface;

a mounting region on said first surface adaptable to mount an optional standard bill validator apparatus of the type having a width of between about 3 and about 4 inches, a height of between about 2 and about 4 inches, and a depth extending from said first surface into said interior volume of said housing of between about 4 inches and about 7 inches;

a bill validator mounting receptacle for mechanically attaching and receiving a standard bill validator apparatus and for containing said bill validator apparatus substantially internal to said housing, said mounting receptacle including an optionally removable panel region located within said first surface and when optionally removed defining an opening sized to receive said bill validator, said mounting receptacle further including a volume of unallocated space extending from said removable panel region into said interior of said housing so that a bill validator apparatus may be mounted within said mounting receptacle and occupy said unallocated space without mechanical interference;

said unallocated volume of space having dimensions at least sufficient to receive a standard bill validator apparatus when said bill validator apparatus is optionally mounted into said mounting receptacle; and a dispensing controller for controlling dispensing of said products or services upon user request and proper payment contained within said housing;

the combination comprising:

a data card scanner apparatus for scanning a magnetic stripe data card and acquiring payment information from information stored on said card in the form of first electrical signals and information regarding the identification of said data card as a promotional use card;

said data card being a magnetic stripe data card and said data card scanner apparatus being a magnetic stripe data card scanner apparatus;

said promotional card containing information encoded on said magnetic stripe of said card identifying it as a promotional use card and defining advanced features provided to the holder of said card upon acceptance of said card by said scanner apparatus;

means for providing advanced dispensing and payment features including recognition and acceptance of said promotional use cards and provision of special dispensing features in response to said recognition and acceptance, said advanced features including restricting use of said promotional data card to the purchase of a particular product or combination of products, restricting each use by limiting the purchase amount to a particular monetary value independent of the value remaining encoded on said promotional data card, restricting acceptance of said promotional data card to particular vending locations or to particular dispensing machine, and providing a price discount on predetermined products when said promotional card is used for the purchase of the predetermined products and thereby promoting a purchase of said predetermined products by a market segment of the general population for whom the price of said particular items have been attractively reduced without reducing the price of said particular items to the general population by virtue of distribution of said promotional use cards only to said market segment;

a scanner interface for interfacing said first electrical signals of said data card scanner with said dispensing controller to indicate proper payment including payment made in the form of advanced features identified by said promotional use data card, said scanner interface electrically interposed between said scanner apparatus and said dispensing controller;

said scanner interface being adapted to be contained entirely inside said housing and being programmatically configurable to receive said first electrical signals and to generate and transmit third electrical signals in response thereto to any one of a plurality of different types of predetermined dispensing controllers which are specially adapted to predefined control signal characteristics of said any one of said predetermined dispensing controllers;

said data card scanner apparatus and interface generating and coupling said third electrical signals to said dispensing machine in substitution of said first electrical signals without either a bill validator apparatus or a coin acceptor apparatus connected to said dispensing controller or to said scanner apparatus;

said data card scanner apparatus having length, width, and depth dimensions so as to permit said scanner to be inserted into said bill validator apparatus mounting receptacle to substitute for or replace said bill validator apparatus in said vending machine;

said data card scanner being contained substantially within said interior of said dispensing machine housing when mounted in said mounting receptacle, except that a fractional portion of the depth of said data card scanner may extend exterior to said housing from said opening to enable access to said data card scanner by a data card presented to said scanner for acceptance external to said housing;

said scanner interface having a disengagably mating interface first connector socket/plug adapted for connection to said dispensing controller connector plug/socket of opposite gender to said first connector so that said scanner interface may be disengagably electrically coupled to said dispensing controller without altering existing wires in said dispensing machine;

said data card scanner being electrically installed into said interior of said dispensing machine housing by engaging said scanner interface first connector socket/plug with said dispenser connector, plug/socket; and said data card scanner being mechanically installed into said interior of said dispensing machine housing by mounting said data card scanner into said bill validator mounting receptacle, including by removing said optionally removable panel region if said panel region has not been previously removed for mounting of a bill validator to open said opening, and by removing one of said bill validators from said opening if one of said bill validators had been mounted so that said data card scanner is electrically and mechanically retrofittable into the interior of a dispensing machine designed to accept a standard bill validator apparatus;

said data card scanner apparatus further comprising means for swallowing said data card when said data card has predetermined characteristics including identification of said card as being defective and identification of said card as a promotional use card when the advanced dispensing feature(s) provided by that promotional card has been used up and independent of any cash value present the card and independent of the physical condition of the card; and means for tracking the purchase patterns of consumers collecting said swallowed promotional use cards having the nature of said card encoded upon the magnetic stripe of the card and tabulating the geographical distribution of said promotional card use;

said data card scanner apparatus identifying said data card as having said predetermined characteristics; and said means for swallowing being responsive to said data card scanner apparatus to swallow said data card.

3. The apparatus in claim 2, wherein said dispensing machine is of the type having a coin acceptor apparatus for accepting coins as cash payment and generating second electrical signals indicative of an amount of cash accepted, said coin acceptor apparatus including a coin acceptor interface for interfacing said second electrical signals with said dispensing controller to indicate proper cash payment;

said coin acceptor interface including a coin mechanism connector coupled to said coin mechanism and a disengagably mating dispensing controller connector coupled to said dispensing controller for coupling said coin acceptor apparatus to said dispensing controller; and wherein said scanner interface further being programmatically configurable to receive said first and second electrical signals and to generate and transmit said third electrical signals in response thereto;

said scanner interface further having a second disengagably mating interface connector adapted for connection to said coin mechanism connector so that said interface may be disengagably electrically coupled between said coin changer apparatus and said dispensing controller; and said data card scanner being electrically installed into said interior of said dispensing machine housing by disengaging said mating connectors coupling said coin changer apparatus with said dispensing controller and by engaging said scanner interface second connector with said coin mechanism connector and engaging said scanner interface first connector with said dispenser connector.

4. The apparatus in claim 2, wherein said data card scanner apparatus is the only payment acceptance means for acquiring payment information coupled to said dispensing controller.

5. A dispensing system for dispensing products or services using a data card as payment means; said dispensing system comprising:

a dispensing machine of the type having:

a dispensing machine housing defining and enclosing an interior space and an interior volume, said housing having a first surface;

a mounting receptacle configurable to accept a standard bill validator apparatus substantially internal to said interior volume of said housing, said receptacle including an optionally removable panel region within said first surface and a volume of unoccupied space extending from said panel region into said interior of said housing;

said removable panel region being an area on said first surface of said housing sufficient in size so as to define, when said optionally removable panel is removed, an opening in said first surface of said housing sized to permit insertion of a standard bill validator apparatus;

said volume of unoccupied space extending from said removable. panel region into said interior of said dispensing machine housing, said unoccupied volume of space having dimensions at least sufficient to receive a standard bill validator apparatus when said apparatus is optionally mounted into said receptacle;

said standard bill validator being of the type having a width of between about 3 and about 4 inches, a height of between about 2 and about 4 inches, and a depth extending from said front surface into said interior volume of said housing of between about 4 inches and about 7 inches;

a dispensing controller responsive to first electrical signals indicating proper payment for controlling dispensing of said products or services upon user request and proper payment contained within said housing;

said dispensing system further comprising:

a magnetic stripe data card scanner apparatus for scanning a magnetic stripe data card and acquiring payment information of a cash value stored on said card in the form of second electrical signals and information regarding the identification of said data card as a promotional use card;

said promotional card containing information encoded on said magnetic stripe of said card identifying it as a promotional use card and defining advanced features provided to the holder of said card upon acceptance of said card by said scanner apparatus;

means for providing advanced dispensing and payment features including recognition and acceptance of said promotional use card and provision of special dispensing and payment features in response to said recognition and acceptance, said advanced features including restricting use of said promotional data card to the purchase of a particular product or combination of products, restricting each use by limiting the purchase amount to a particular monetary value independent of the value remaining encoded on said promotional data card, restricting acceptance of said promotional data card to particular vending locations or to particular dispensing machines, and providing a price discount on predetermined products when said promotional card is used for the purchase of the predetermined products and thereby promoting a purchase of said predetermined products by a market segment of the general population for whom the price of said particular items have been attractively reduced without reducing the price of said particular items to the general population by virtue of distribution of said promotional use cards only to said market segment;

said data card scanner apparatus further comprising means for swallowing said data card when said data card has predetermined characteristics including identification of said card as being defective and upon identification of said card as a promotional use card when the advanced dispensing feature provided by that promotional card has been used up and independent of any remaining cash value present on the card and independent of the physical condition of the card; and means for tracking the purchase patterns of consumers collecting said swallowed promotional use cards having the nature of said card encoded upon the magnetic stripe of the card and tabulating the geographical distribution of said promotional card use;

said means for swallowing being contained within said interior volume of said dispensing machine housing;

said data card scanner apparatus identifying said data card as having said predetermined characteristics; and said means for swallowing being responsive to said data card scanner apparatus to swallow said data card; and a second interface for interfacing said second electrical signals with said dispensing controller to indicate proper payment;

said second interface being adapted to be contained inside said housing and being software or firmware programmatically configurable to receive said second electrical signals from early one of a plurality of different types of predetermined dispensing controllers and to generate and transmit third electrical signals to said dispensing controller which are specifically adapted to defined control signal characteristics of said any one of said predetermined dispensing controller;

said data card scanner apparatus having length, width, and depth and volume dimensions sized so as to permit said scanner apparatus to be inserted into said bill validator apparatus slot, whereby said scanner can optionally replace and be installed instead of said bill validator apparatus in said housing;

said data card scanner being mounted within said standard bill validator receptacle to replace said bill validator in the same manner that said standard bill validator apparatus is normally mounted and being contained substantially within said interior of said dispensing machine housing, except that a portion of said data card scanner may extend exterior to said housing provide access to said scanner apparatus from the exterior of said dispensing machine so that said data card may be inserted into said scanner apparatus.

* * * * *